US005333200A

United States Patent [19]

Cooper et al.

[11] Patent Number: 5,333,200

[45] Date of Patent: Jul. 26, 1994

[54] HEAD DIFFRACTION COMPENSATED STEREO SYSTEM WITH LOUD SPEAKER ARRAY

[76] Inventors: Duane H. Cooper, 918 W. Daniel St., Champaign, Ill. 61821; Jerald L. Bauck, 4520 E. Baseline Rd. #1089, Phoenix, Ariz. 85044

[21] Appl. No.: 924,345

[22] Filed: Aug. 3, 1992

Related U.S. Application Data

[60] Continuation-in-part of Ser. No. 713,830, Jun. 12, 1991, Pat. No. 5,136,651, which is a continuation of Ser. No. 397,380, Aug. 22, 1989, Pat. No. 5,034,983, which is a division of Ser. No. 109,197, Oct. 15, 1987, Pat. No. 4,893,342.

[51] Int. Cl.[5] ..... H04S 1/00

[52] U.S. Cl. ..... 381/1; 381/24; 381/27; 381/25

[58] Field of Search ..... 381/25, 1, 24, 27

[56] References Cited

U.S. PATENT DOCUMENTS

| | | | |
|---|---|---|---|
| 4,418,243 | 11/1983 | Fixler | 381/24 |
| 4,968,154 | 11/1990 | Baeg | 381/18 |
| 5,027,403 | 6/1991 | Short et al. | 381/24 |
| 5,109,416 | 4/1992 | Croft | 381/24 |
| 5,113,447 | 5/1992 | Hatley et al. | 381/27 |
| 5,197,100 | 3/1993 | Shiraki | 381/24 |

OTHER PUBLICATIONS

Cooper, Duane H., "Calculator Program for Head-Related Transfer Function", *Audio Engineering Society*, vol. 30, No. 1/2, 1982 Jan./Feb., pp. 34-38.

"Controlling Sound-Image Localization in Steriophonic Reproduction", *J. Audio Engineering Society*, vol. 29, No. 11, 1981, Nov., pp. 794-799.

"Controlling Sound-Image Localization in Stereophonic Reproduction: Part II*", *J. Audio Engineering Society*, vol. 27, No. 1/2, 1979 Jan./Feb., pp. 32-39.

"Precision Sound-Image Localization Technique Utilizing Multitrack Tape Masters*", *Audio Engineering Society*, vol. 27, No. 1/2, 1979 Jan./Feb., pp. 32-39.

"On the simulation of sound localization", *J. Acoust. Soc. Jpn* (E) 1,3 (1980), pp. 167-174. Bartlet, Bruce, Recording Techniques: Simple Stereo Microphone Techniques, db Sep.-Oct. 1986.

"On Acoustical Specification of Natural Stereo Imaging", An Audio Engineering Society Reprint (Presented at the 66th Convention 1980, May 6-9, Los Angeles), 1649 (H-7), pp. 1-53.

Schwarz, Von L., "Zur Theorie der Beugung einer ebenen Schallwelle an der kugel", *Akustishe Zeitschrift* 1943, pp. 91-117.

Schroeder, M. R., et al., "Computer Simulation of Sound Transmission in Rooms", *IEEE Conv. Record*, Pt. 7, pp. 150-155 (1963).

Schroeder, M. R., "Digital Simulation of Sound Transmission in Reverberant Spaces", *J. Acoust. Soc. Am.*, vol. 47, pp. 424-431 (Feb. 1970).

Schroeder, M. R., "Computer Models for Concert Hall Acoustics", *Am. Journal Phys.*, vol. 41, pp. 461-471 (Apr. 1973).

Schroeder, M. R., "Models of Hearing," *Proc. IEEE*, vol. 6, pp. 1332-1350 (Sep. 1975).

(List continued on next page.)

*Primary Examiner*—Forester W. Isen

*Attorney, Agent, or Firm*—Welsh & Katz, Ltd.

[57] ABSTRACT

A stereo audio processing system for a stereo audio signal processing reproduction that provides improved source imaging and simulation of desired listening environment acoustics while retaining relative independence of listener movement. The system first utilizes a synthetic or artificial head microphone pickup and utilizes the results as inputs to a cross-talk cancellation and naturalization compensation circuit utilizing minimum phase filter circuits to adapt the head diffraction compensated signals for use as loudspeaker signals. The system provides for head diffraction compensation including cross-coupling while permitting listener movement by limiting the cross-talk cancellation and diffraction compensation to frequencies substantially below approximately ten kilohertz.

50 Claims, 17 Drawing Sheets

OTHER PUBLICATIONS

Damaske, P., "Head-Related Two-Channel Stereophony with pt. 2", pp. 1109-1115 (Oct. 1971).

Mehrgardt, S., et al., "Transformation Characteristics of the External Human Ear," *J. Acoust. Soc. Am.*, vol. 61, pp. 1567-1576 (Jun. 1977).

Cooper, H., et al., "Corrections to L. Schwarz, 'On the Theory of Diffraction of a Plane Soundwave Around a Sphere' ['Zur Theorie der Beugung einer ebenen Schallwelle an der Kugel,' Akust.Z. 8, 91-117 (1943)]," *J. Acoust. Soc. Am.*, vol. 80, pp. 1793-1802 (Dec. 1986).

Gerzon, M. A., "Stereo Shuffling: New Approach—Old Technique," *Studio Sound*, pp. 123-130 (Jul. 1986).

Parsons, T. W., "Super Stereo" Wave of the Future? *The Audio Amateur*, vol. IX, pp. 19-20 (Jun. 1978).

Nakabayashi, K., "A Method of Analyzing the Quadraphonic Sound Field," *J. Audio Eng. Soc.*, vol. 23, pp. 187-193 (Apr. 1975).

Snow, William B., "Basic Principles of Stereophonic Sound" *Journal of the SMPTE*, vol. 61, pp. 567-589 (Nov. 1953).

Nelson, P., et al., "Adaptive Inverse Filters for Stereophonic Sound Reproduction," *IEEE Transaction on Signal Processing*, vol. 40, No. 7, pp. 1621-1631 (Jul. 1992).

151
152
154
155
156
157
160
150
162
164
166
167
168
170
172
LF
174
RF
176
Rθ
Lθ
2a
Ø
-1
-1

50
52
54
56
58
60
62
64
66
72
74
76
78
80
82
84
S'G
S'G
A'F
A'F
RF
LF
Rθ
Lθ
Ø

INTEGRATOR
INVERTER
BQ 1 Δ
BQ 2 Δ
BQ 3 Δ
BQ 4 Δ
BQ 5 Δ
BQ 1 Σ
BQ 2 Σ
BQ 3 Σ
BQ 4 Σ
Σ
Δ
-1
LOW FREQ SHUFFLER
ABOVE-600Hz CROSSTALK CANCELER
154
156
158
160
162
170
172
173
174
180
182
184
190
192
194
195
196
197
198

90°
85°
302
$L_s$
5°
0°
INPUTS
-5°
300
$R_s$
-85°
-90°
304
0°
±5°
±85°
±90°
Σ'
Δ'
Σ'
Δ'
Σ'
Δ'
Σ'
+
Σ'
308
+
Δ'
$L_e$
OUTPUTS
306
Σ
310
$R_e$

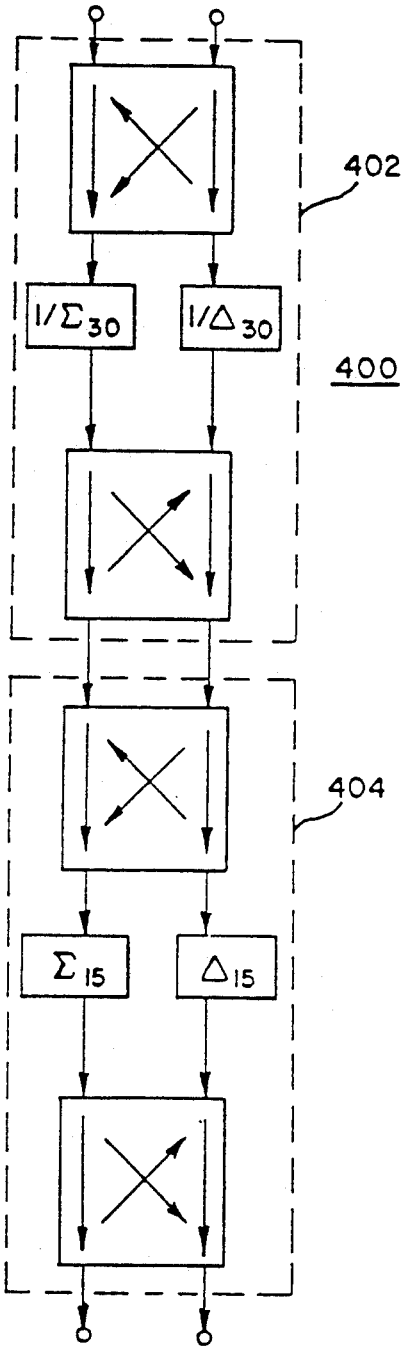
FIG. 10a
FIG. 10b
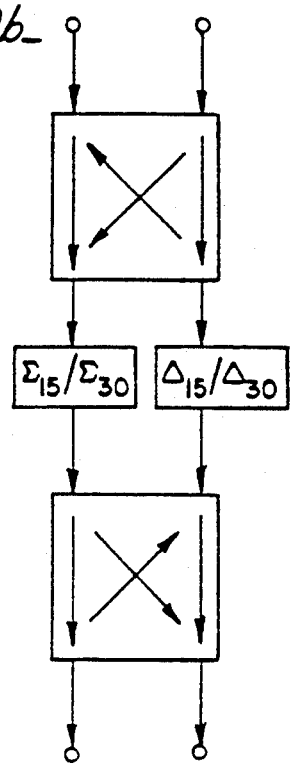
FIG. 11
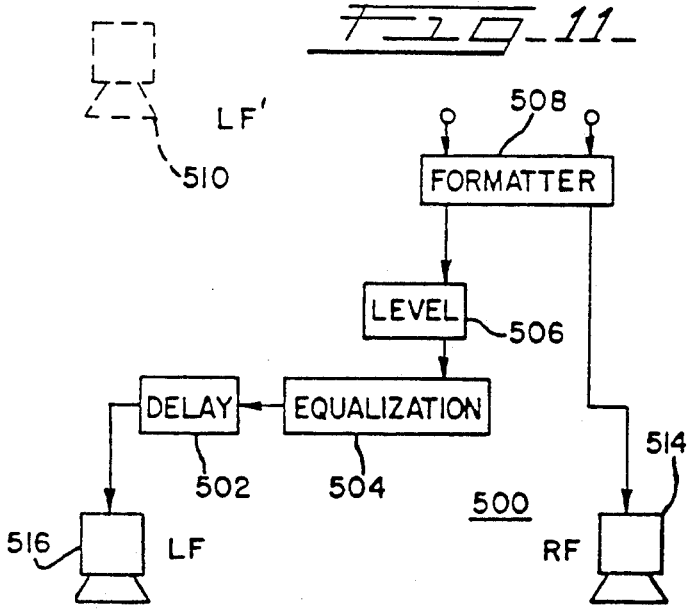
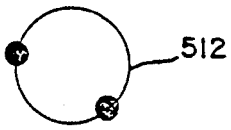

HEAD DIFFRACTION COMPENSATED STEREO SYSTEM WITH LOUD SPEAKER ARRAY

CROSS REFERENCES TO RELATED APPLICATIONS

This is a continuation-in-part of application Ser. No. 713,830 filed Jun. 12, 1991, now U.S. Pat. No. 5,136,651 which is a continuation of U.S. Pat. No. 5,034,983 filed as Ser. No. 397,380 on Aug. 22, 1989 which is a division of U.S. Pat. No. 4,893,342 filed as Ser. No. 109,197 on Oct. 15, 1987 and issued Jan. 9, 1990.

BACKGROUND OF THE INVENTION

This invention relates generally to the field of audio-signal processing and more particularly to a system for stereo audio-signal processing and stereo sound reproduction incorporating head-diffraction compensation, which provides improved sound-source imaging and accurate perception of desired source-environment acoustics while maintaining relative insensitivity to listener position and movement.

There is a wide variety of prior-art stereo systems, most of which fall within three general categories or types of systems. The first type of stereo system utilizes two omnidirectional microphones usually spaced approximately one half to two meters apart and two loudspeakers placed in front of the listener towards his left and right sides in correspondence one for one with the microphones. The signal from each microphone is amplified and transmitted, often via a recording, through another amplifier to excite its corresponding loudspeaker. The one-for-one correspondence is such that sound sources toward the left side of the pair of microphones are heard predominantly in the left loudspeaker and right sounds in the right. For a multiplicity of sources spread before the microphones, the listener has the impression of a multiplicity of sounds spread before him in the space between the two speakers, although the placement of each source is only approximately conveyed, the images tending to be vague and to cluster around loudspeaker locations.

The second general type of stereo system utilizes two unidirectional microphones spaced as closely as possible, and turned at some angle towards the left for the leftward one and towards the right for the rightward one. The reproduction of the signals is accomplished using a left and right loudspeaker placed in front of the listener with a one-for-one correspondence with the microphones. There is very little difference in timing for the emission of sounds from the loudspeakers compared to the first type of stereo system, but a much more significant difference in loudness because of the directional properties of the angled microphones. Moreover, such difference in loudness translates to a difference in time of arrival, at least for long wavelengths, at the ears of the listener. This is the primary cue at low frequencies upon which human hearing relies for sensing the direction of source. At higher frequencies (i.e., above 600 Hz), directional hearing relies more upon loudness differences at the ears, so that high frequency sounds in such stereo systems have thus given the impression of tending to be more localized close to the loudspeaker positions rather than spread as the original sources had been.

The third general type of stereo system synthesizes an array of stereo sources, by means of electrical dividing networks, whereby each source is represented by a single electrical signal that is additively mixed in predetermined proportions into each of the two stereo loudspeaker channels. The proportion is determined by the angular position to be allocated for each source. The loudspeaker signals have essentially the same characteristic as those of the second type of stereo system.

Based upon these three general types of stereo systems, there are many variants. For example, the first type of system may use more than two microphones and some of these may be unidirectional or even bidirectional, and a mixing means as used in the third type of system may be used to allocate them in various proportions between the loudspeaker channels. Similarly, a system may be primarily of the second type of stereo system and may use a few further microphones placed closed to certain sources for purposes of emphasis with signals to be proportioned between the channels. Another variant of the second type of stereo system makes use of a moderate spacing, for example 150 mm, between the microphones with the left angled microphone spaced to the left, and the right-angle microphone spaced to the right. Another variant uses one omnidirectional microphone coincident, as nearly as possible, with a bidirectional microphone. This is the basic form of the MS (middle-side) microphone technique, in which the sum and difference of the two signals are substantially the same as the individual signals from the usual dual-angled microphones of the second type of system.

Variants are also known that focus on loudspeaker arrangements. A well-known example has a third loudspeaker centered between the stereo pair, to be driven by a signal proportional to the so-called mono sum, the sum of the stereo signals, a style of connection also known as bridging. Use of this loudspeaker is supposed to remedy a lack of stereo imaging in the center, a so-called hole in the middle, and also to stabilize the imaging against varying listener position. The center loudspeaker is common in cinema-sound arrangements in which it is centered behind the acoustically transparent screen. Such centered loudspeakers are discussed in W. B. Snow, "Basic Principles of Stereophonic Sound," J. Soc. Mot. Pict. and Telev. Eng., Vol. 61 (November 1953). Cinema sound now often uses special circuits called "logic" to steer the mono sum wholly into this center channel for dialog, which would otherwise be so imprecisely localized as to be distracting. Surround-sound arrangements are not pursued here in favor of frontal arrangements that may, however, include four loudspeakers.

Each of these systems has its advantages and disadvantages and tends to be favored and disfavored according to the desires of the user and according to the circumstances of use. Each fails to provide localization cues at frequencies above approximately 600 Hz. Many of the variants represent efforts to counter the disadvantages of a particular system, e.g., to improve the impression of uniform spread, to more clearly emulate the sound imaging, to improve the impression of "space" and "air," etc. Nevertheless, none of these systems adequately reckons with the effects upon a soundwave of propagation in the space close to the head in order to reach the ear canal. This head diffraction substantially alters both the magnitude and phase of the soundwave, and causes each of these characteristics to be altered in a frequency-dependent manner.

The use of head-diffraction compensation to make greatly improved stereo sound in a loudspeaker system was demonstrated by M. R. Schroeder and B. S. Atal to emulate the sounds of various concert halls with extraordinary accuracy. Schroeder measured the values of head-related transfer functions for an artificial or "dummy" head (i.e., a physical replica of a head mounted on a fully-clothed manikin) that had microphones placed in its ear canals. This information was used to process two-channel sound recorded using a second artificial head (i.e., to process a binaural recording). Since each ear hears both speakers, the system used crosstalk cancellation to cancel the effects of sound traveling around the listener's head to the opposite ear. Crosstalk cancellation was performed over the entire audio spectrum (i.e., 20 Hz to 20 KHz)

For a listener whose head reasonably well matched the characteristics of the manikin head, the result was a great improvement in characteristics such as spread, sound-image localization and space impression. However, the listener had to be positioned in an exact "sweet spot" and if the listener turned his head more than approximately ten degrees, or moved more than approximately 6 inches the illusion was destroyed. Thus, the system was far too sensitive to listener position and movement to be utilized as a practical stereo system.

Head simulation and head compensation used together also permit loudspeaker reformatting. A loudspeaker reformatter converts input signals intended for a specific loudspeaker bearing angle (e.g., ±30°). into a format for presentation at another loudspeaker bearing angle (e.g., ±15°). One application of a reformatter exists in television stero wherein it is very difficult to mount loudspeakers in the television cabinet so that they would be placed at bearing angles as large as ±0° for a viewer. Another application may be found in a listening room that is too narrow for ±30° placement because of a need to place a substantial distance between each loudspeaker and its corresponding sidewall, together with a desire to be seated not too close to the loudspeakers. In this way, it is possible to be forced to accept a small angle, perhaps ±15°, for loudspeaker placement, yet retain the imaging more nearly characteristic of ±30° by using a reformatter. A narrow angular range for loudspeaker placement (narrow speaker base) also permits a wide range in listener position.

As improved television standards, including those for higher picture definition, wider-aspect pictures, and enhanced sound quality, are developed, the need for enhanced sound-image stability increase. Narrow-base speaker arrays with image-spread reformatting are an attractive application of this technology, almost regardless of the stereo technology to be employed.

It is accordingly an object of the invention to provide a novel stereo system which provides enhanced sound-imaging localization which is relatively independent of listener position and movement.

It is another object of the invention to provide a novel stereo system for adapting sound signals utilizing head-diffraction functions, and crosscoupling with filtering to substantially limit the frequency range of such processing to substantially below approximately ten kilohertz to provide enhanced source imaging and accurate perception of simulated acoustics in such frequency range.

It is a further object of the invention to provide means of utilizing head-diffraction functions so that they may be simulated by means of simple electrical analog or digital filters, in most cases of the minimum-phase type.

Briefly, according to one embodiment of the invention, an audio processing system for reformatting is provided including means for providing two channels of binaural signals. In addition, means are provided for cross-talk cancellation, and means for naturalization compensation to correct for the cross-talk cancellation and for propagation path distortions to produce a sum and a difference filtered signal and including filtering means for substantially limiting the cross-talk cancellation and naturalization compensation to frequencies. Summing and differencing means are provided for generating a sum output, a difference output and at least one other output from the sum and difference filtered signals.

BRIEF DESCRIPTION OF THE DRAWINGS

The invention, together with further objects and advantages thereof, may be understood by reference to the following description taken in conjunction with the accompanying drawings.

3A, showing first alternative modifications, used in explaining the invention.

Figure 1C:
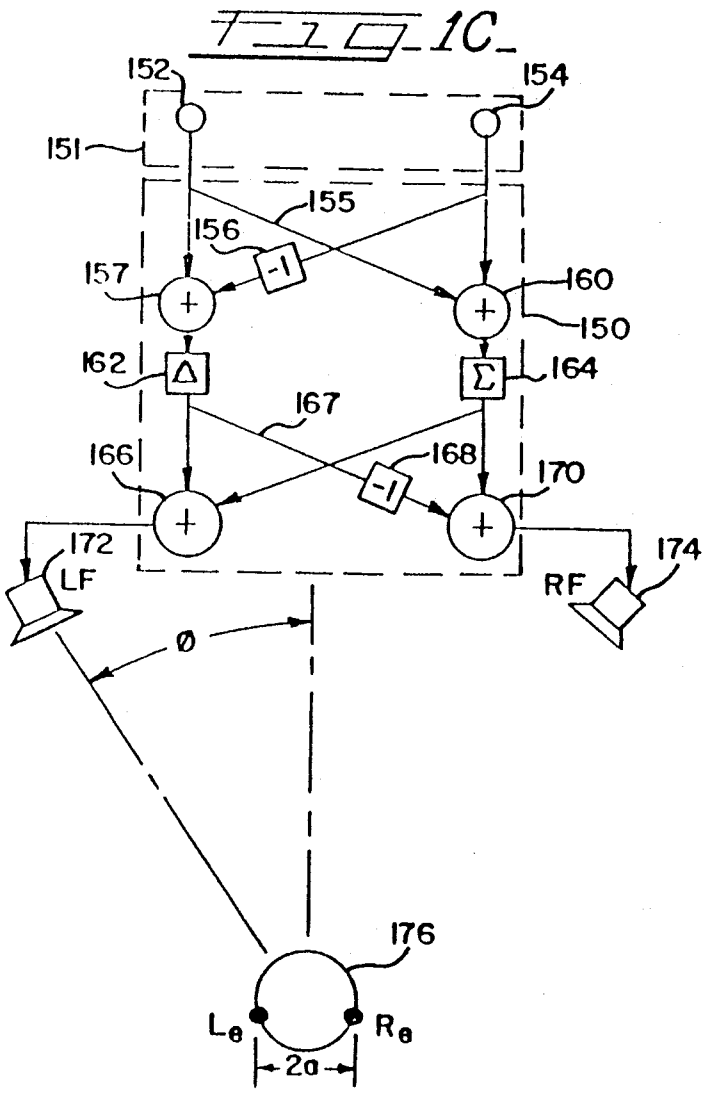
FIG. 1C is a generalized block diagram illustrating another specific embodiment of a stereo audio processing system according to the invention.
Figure 1A:
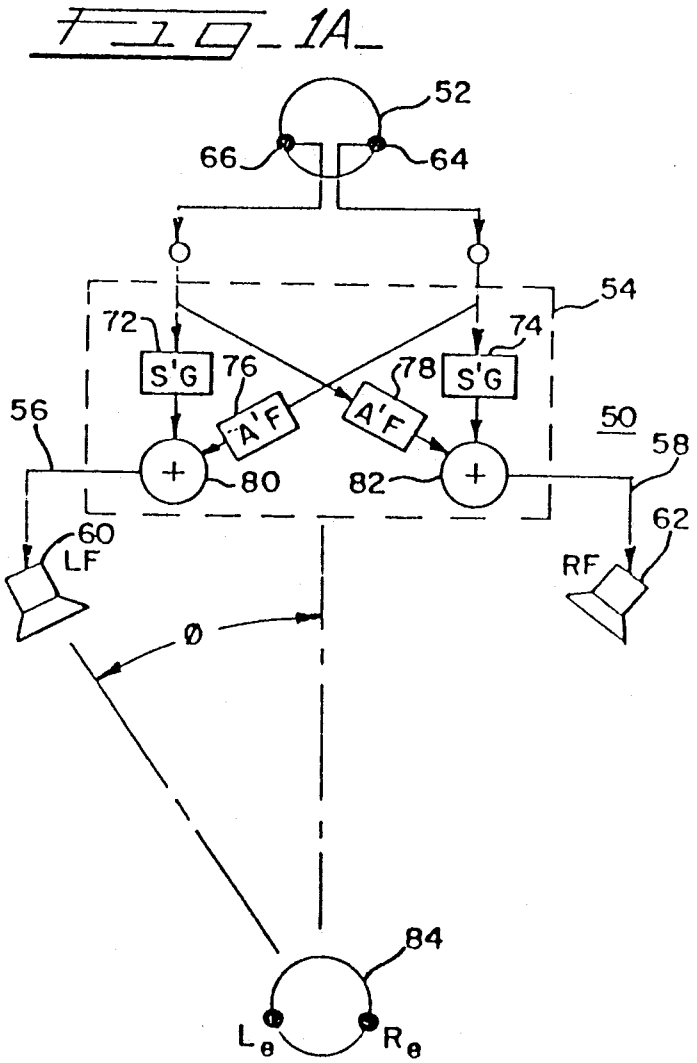
FIG. 1A is a generalized block diagram illustrating a specific embodiment of a stereo audio processing system according to the invention.
Figure 2A:
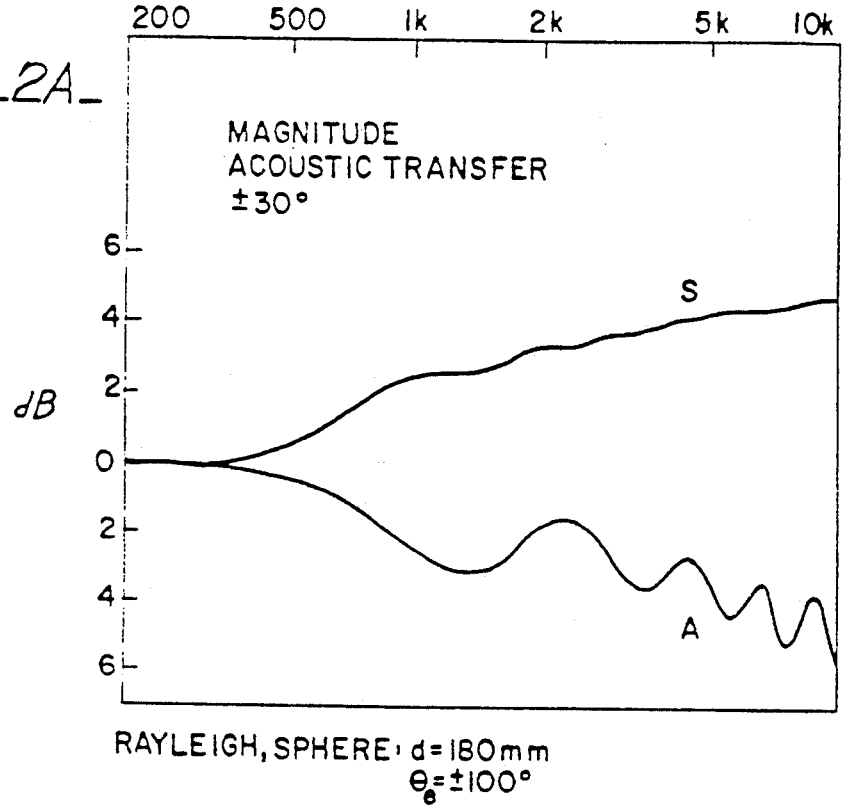
FIG. 2A is a set of magnitude (dB)-versus-frequency-(log scale) response curves of the transfer characteristics from a loudspeaker at 30° to an ear on the same side, curve, S, and to the alternate ear, curve A, used in explaining the invention.
Figure 2B:
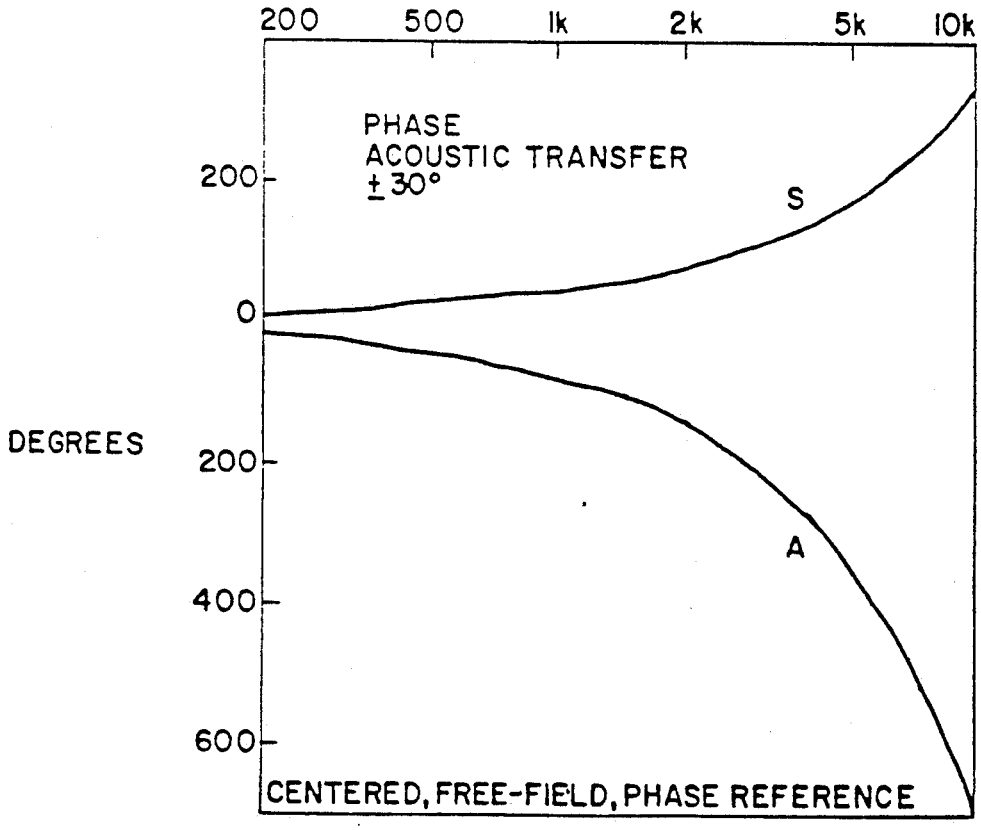
FIG. 2B is a set of phase-(degrees)-versus-frequency-(log scale) response curves of the transfer characteristics from a loudspeaker at 30° to an ear on the same side, curve S, and to the alternate ear, curve A, used in explaining the invention.
Figure 2C:
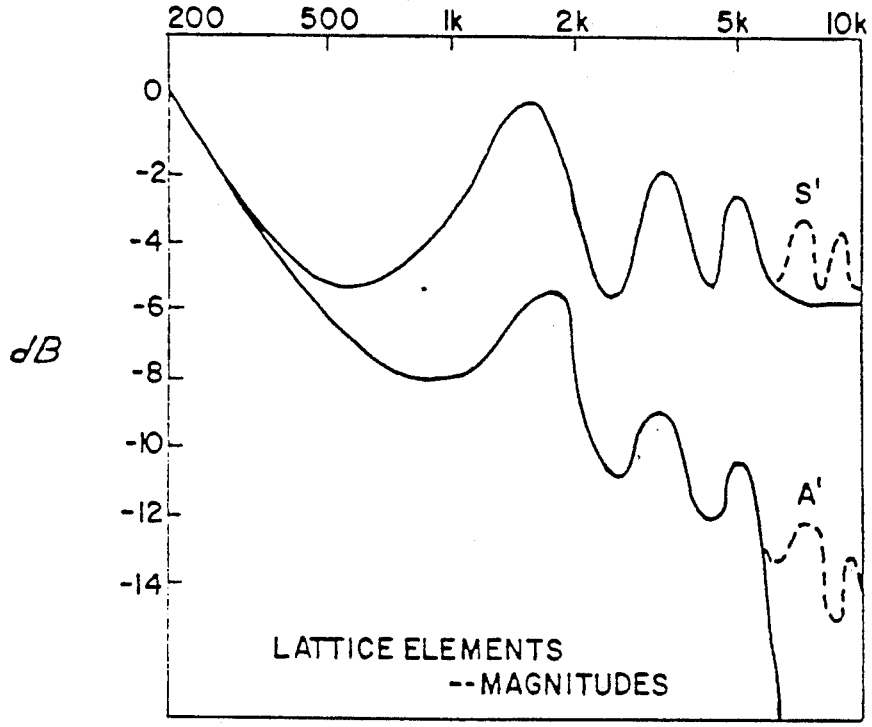
FIG. 2C is a set of magnitude-(dB)-versus frequency-(log scale) response curves of the transfer characteristics of the filters shown in FIG. 1A, filters S' and A', continuing in dashed line, and as modified by the factors G and F, respectively, continuing in solid line, used in explaining the invention.
Figure 3A:
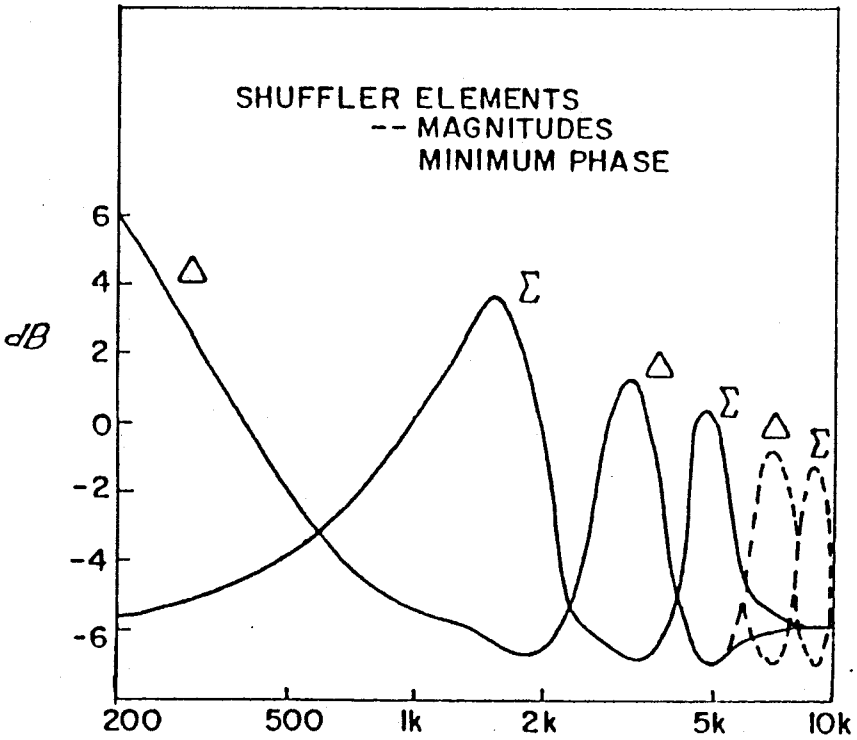
FIG. 3A is a set of magnitude-(dB)-versus frequency-(log scale) response curves of the transfer characteristics of a specific embodiment of the filters shown in FIG. 1C, filters Delta (Δ) and Sigma (Σ) continuing in dashed line, and as modified in their synthesis, continuing in solid line, modifications alternatively accounting for the modifications represented by the filters factors G and F, as shown in FIG. 2C, used in explaining the invention.
Figure 3B:
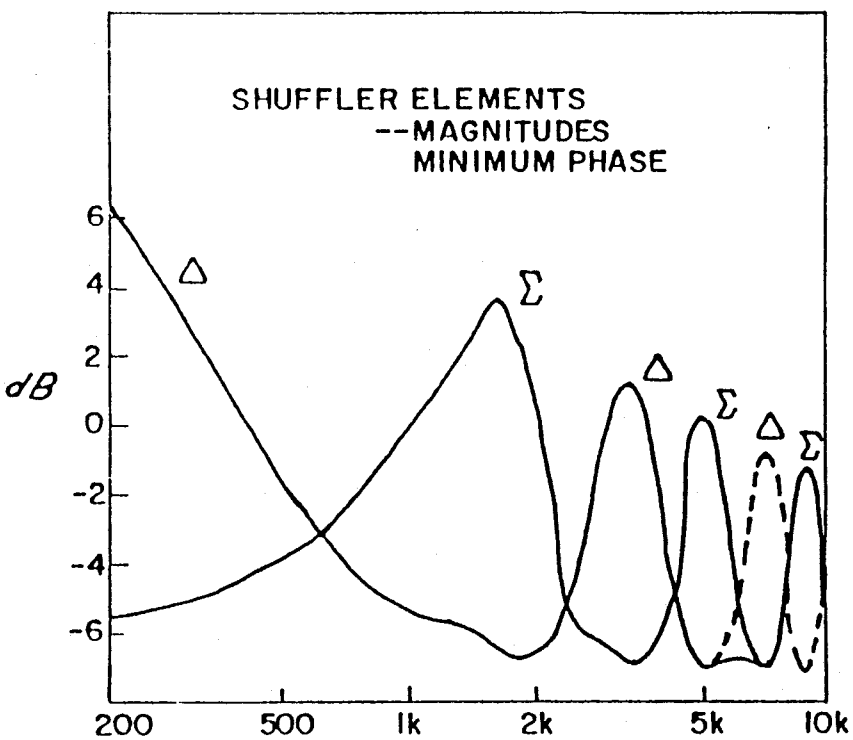
FIG. 3B is a set of magnitude-(dB)-versus-frequency-(log scale) response curves of the transfer characteristics of a specific embodiment of the filters shown in FIG. 1C, having characteristics similar to those in FIG.
Figure 3C:
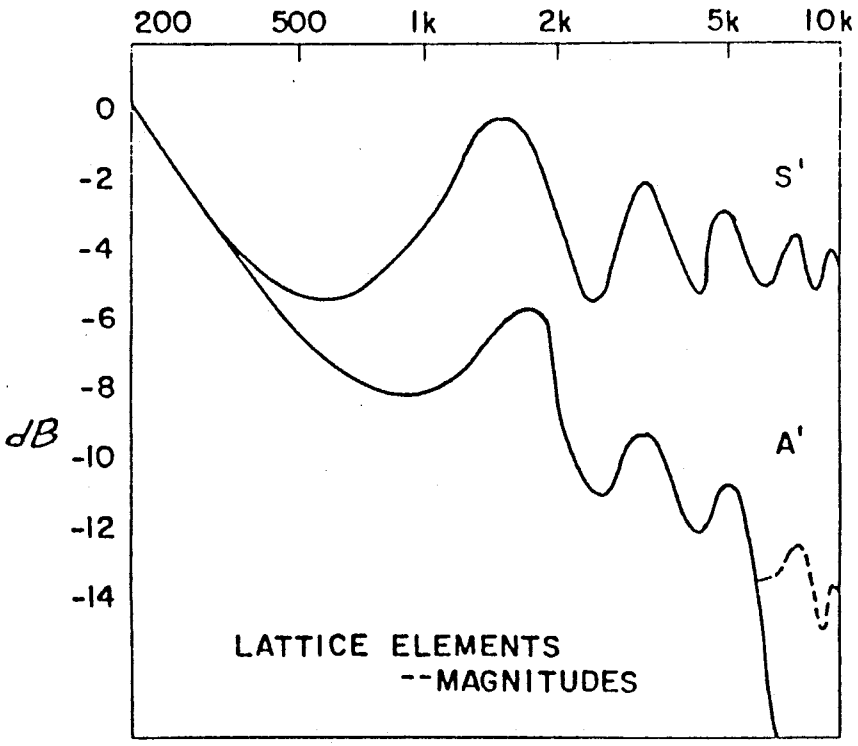

FIG. 3C is a set of magnitude-(dB)-versus-frequency-(log scale) response curves of the transfer characteristics of the specific embodiment of the filters shown in FIG. 1A, having characteristics similar to those shown in FIG. 2C, showing the modifications therein that are the consequences of the alternative modifications shown in FIG. 3B, used in explaining the invention.

Figure 4A:
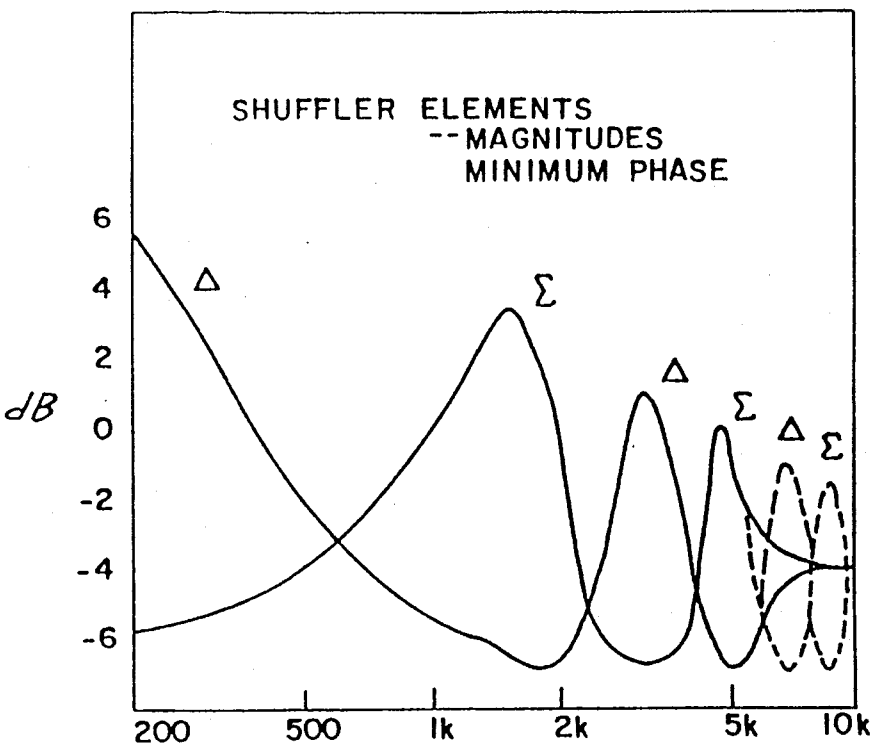

FIG. 4A is a set of magnitude-(dB)-versus-frequency-(log scale) response curves of the transfer characteristics of a specific embodiment of the filters shown in FIG. 1C, having characteristics similar to those shown in FIG. 3A, showing second alternative modifications, used in explaining the invention.

Figure 4C:
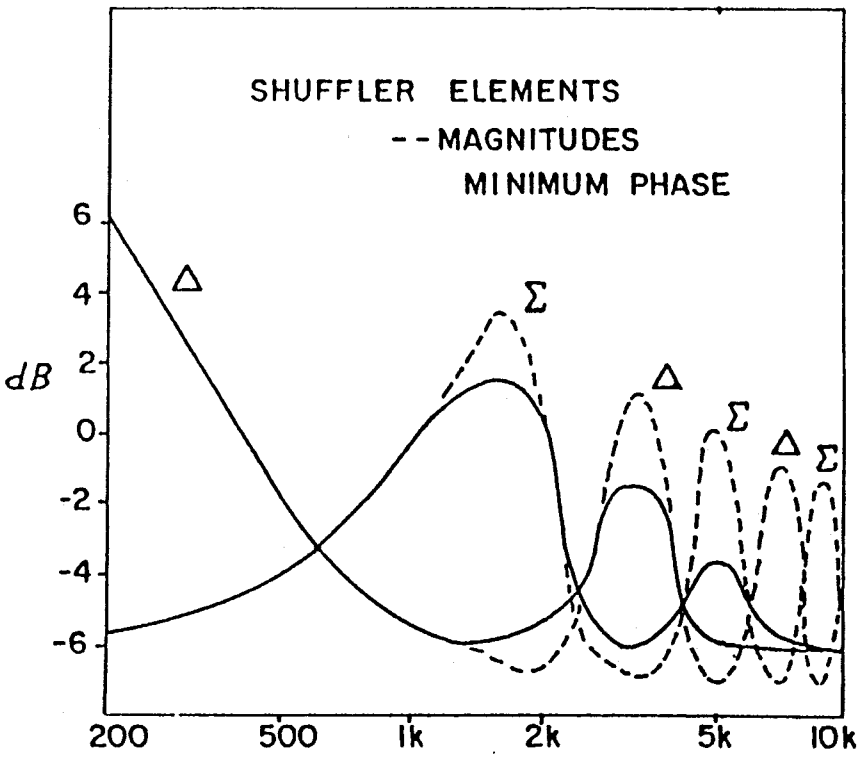
Figure 4B:
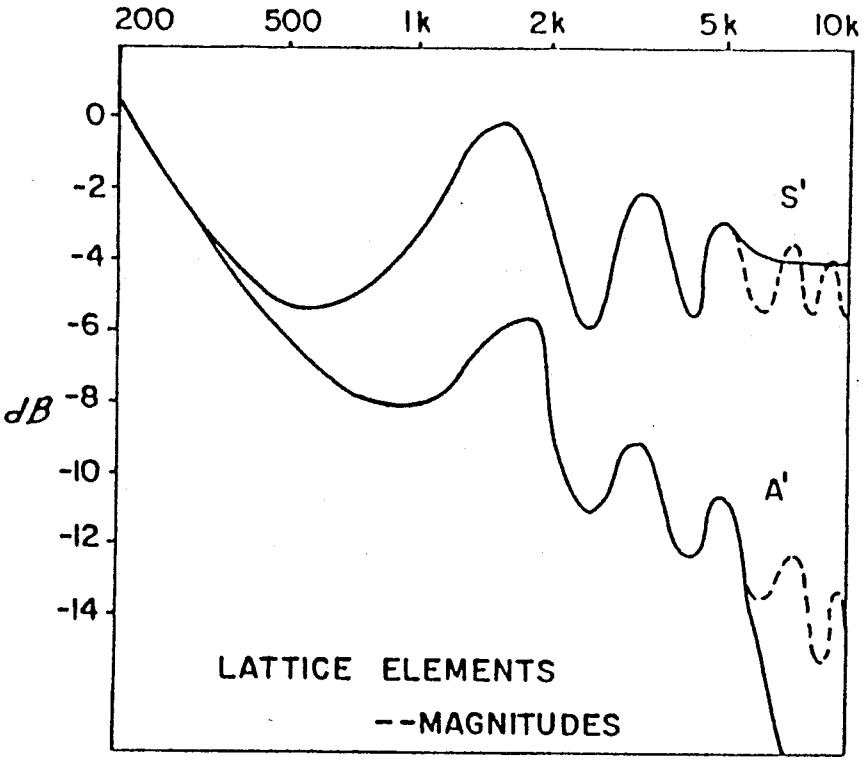

FIG. 4B is a set of magnitude-(dB)-versus-frequency-(log scale) response curves of the transfer characteristics of a specific embodiment of the filters shown in FIG. 1A, having characteristics similar to those shown in FIG. 2C, showing the modifications therein that are the consequences of the alternative modifications shown in FIG. 4A, used in explaining the invention.

FIG. 4C is a set of magnitude-(dB)-versus-frequency-(log scale) response curves of the transfer characteristics of a specific embodiment of the filters shown in FIG. 1C, having characteristics similar to those shown in FIG. 3A, showing third alternative modifications, used in explaining the invention.

Figure 5A:
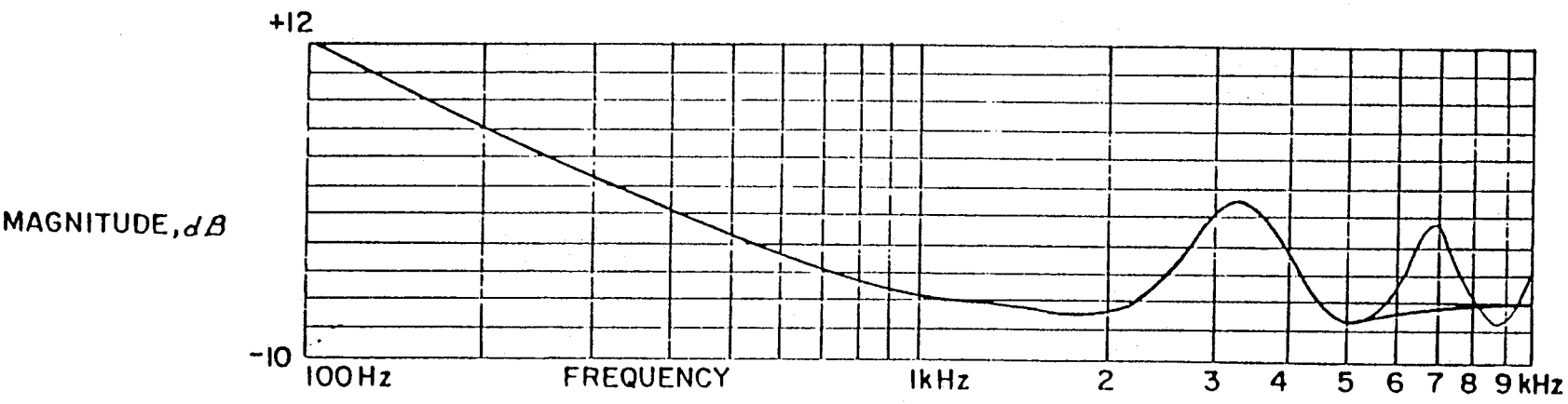

FIG. 5A is a set of magnitude-(dB)-versus-frequency-(log scale) computer-generated response curves of the transfer characteristics of the Delta filter shown in FIG. 1C, having characteristics similar to those shown for the Delta filter in FIG. 3A, showing in dashed line the diffraction-computation specification, and in solid line the approximation thereto, with modification, computed for the synthesis via a specific sequence of biquadratic filter elements, used in explaining the invention.

Figure 5B:
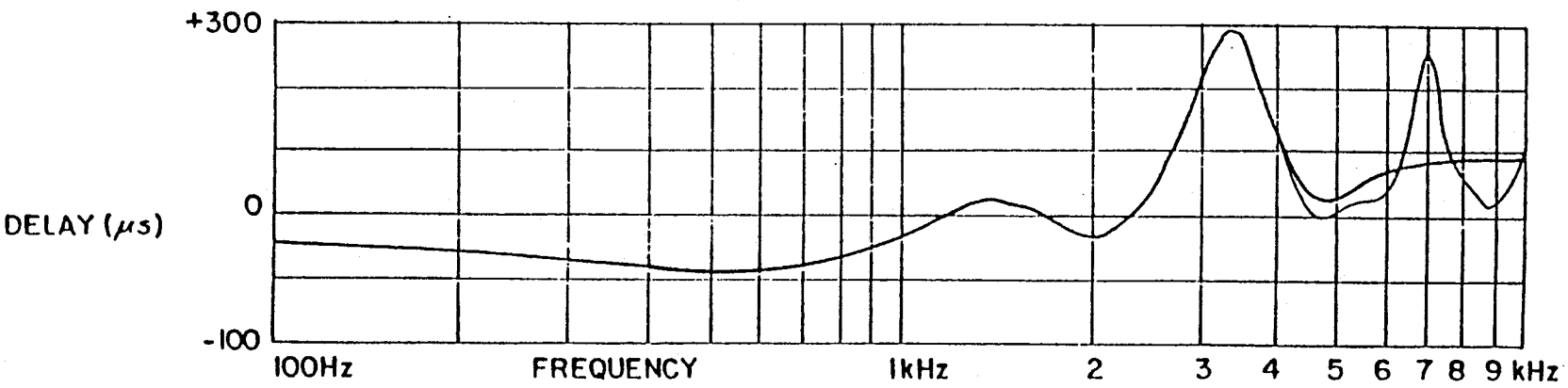

FIG. 5B is a set of delay-(vs)-versus-frequency-(log scale) computer-generated response curves of the transfer characteristics consequent to the magnitude characteristics of FIG. 5A, with a biquadratic-synthesis curve (minimum phase) shown in solid line, used in explaining the invention.

Figure 5C:
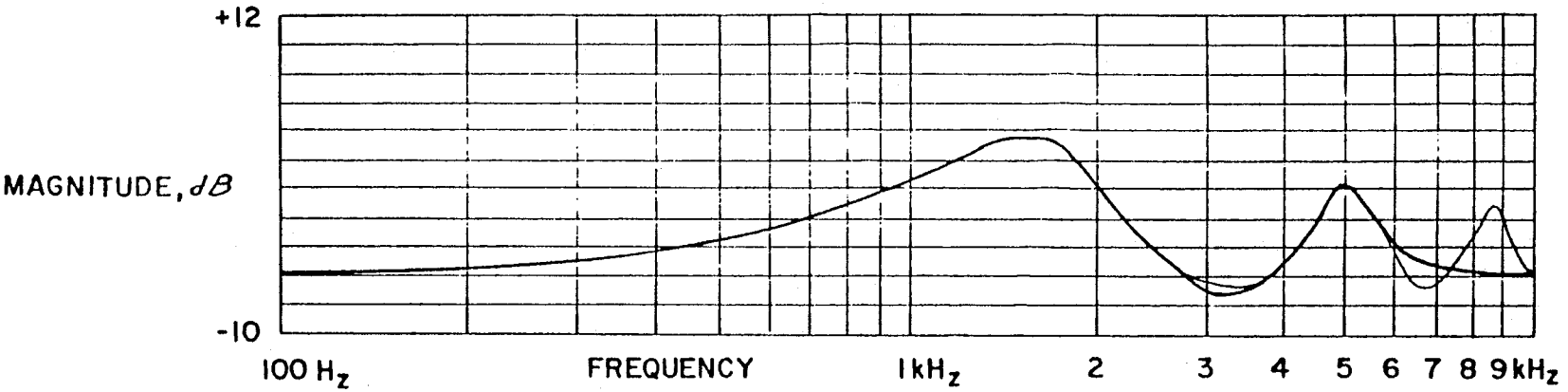

FIG. 5C is a set of magnitude-(dB)-versus-frequency-(log scale) computer-generated response curves of the transfer characteristics of the Sigma filter shown in FIG. 1C, characteristics similar to those shown for the Sigma filter in FIG. 3A, showing in dashed line the diffraction-computation specifications, and in solid line the approximation thereto, with modifications, computed for the synthesis via a specific sequence of biquadratic filter elements, used in explaining the invention.

Figure 5D:
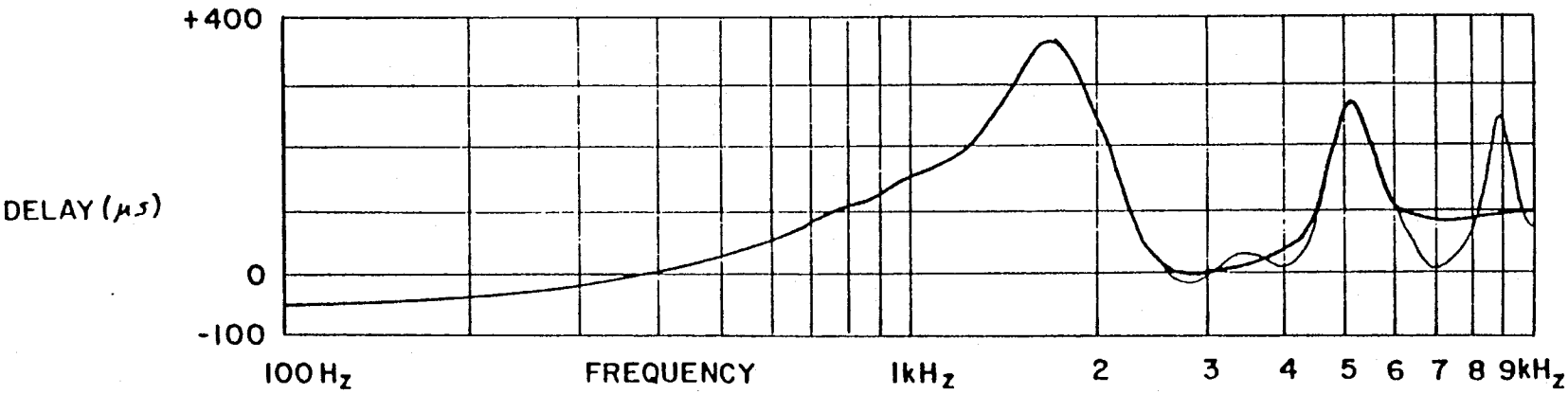

FIG. 5D is a set of delay-(vs)-versus-frequency-(log scale) computer-generated response curves of the transfer characteristics consequent to the magnitude characteristics of FIG. 5A, with a biquadratic-synthesis curve shown in solid line, used in explaining the invention.

Figures 6A, 6B, 6C:
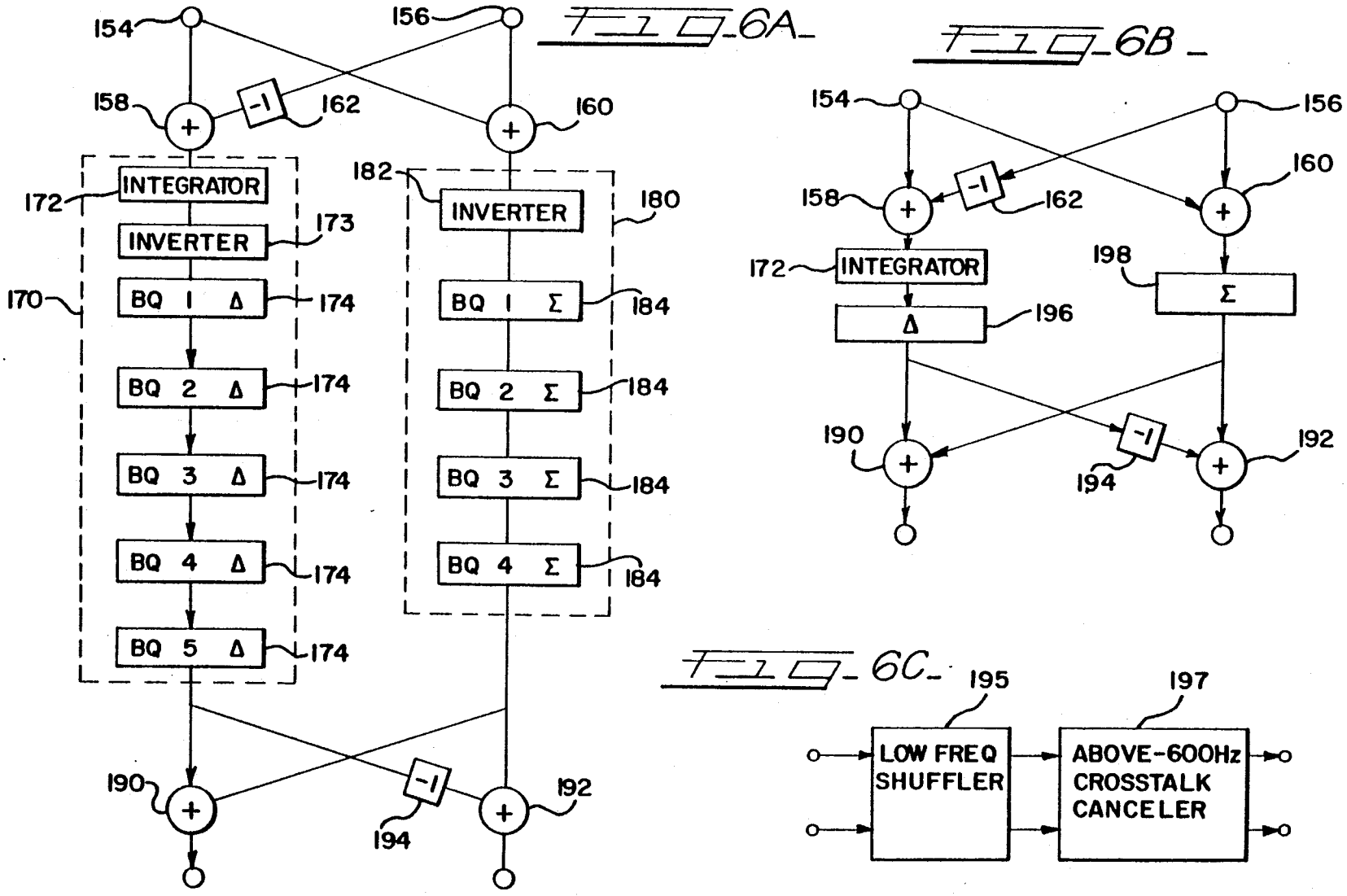

FIG. 6A is a block diagram of a specific embodiment of a circuit illustrating sequences of biquadratic filter elements to obtain the solid line curves of FIG. 5A through FIG. 5D in accordance with the invention.

FIG. 6B is a block diagram, generalized from FIG. 6A by suppressing the showing of cascade-connected biquad filter elements, illustrating a specific embodiment of a stereo audio processing system for crosstalk cancellation according to the invention.

FIG. 6C is a generalized block diagram illustrating a specific embodiment for the insertion of a shuffler circuit in a stereo audio processing system for crosstalk cancellation according to the invention.

Figure 7:
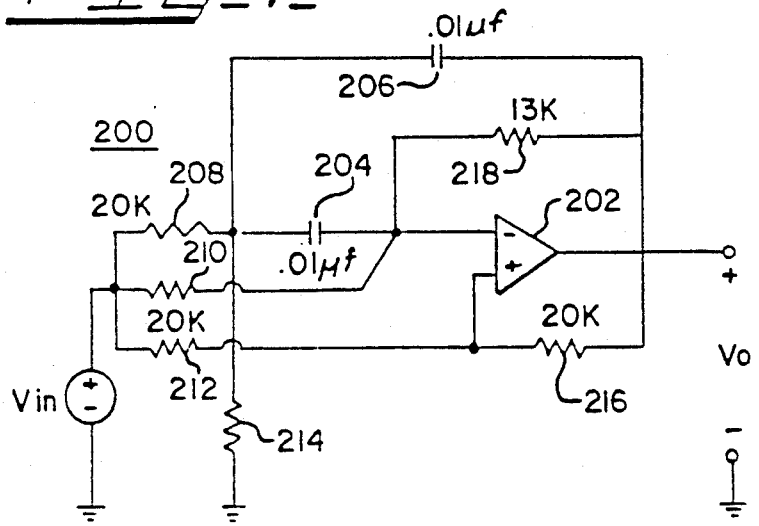

FIG. 7 is a schematic diagram illustrating a specific embodiment of a biquadratic filter element, in accordance with the invention.

Figure 8A:
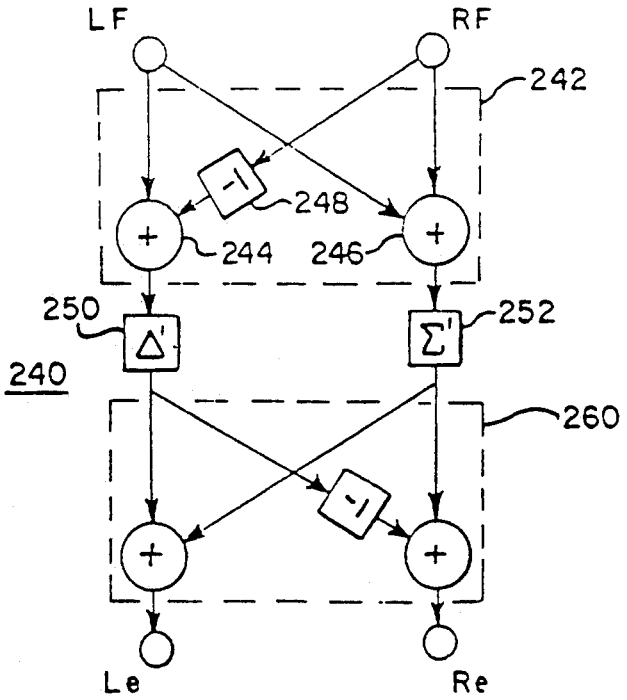

FIG. 8A is a generalized block diagram illustrating a specific embodiment of a shuffler-circuit inverse formatter according to the invention to produce binaural earphone signals from signals intended for loudspeaker presentation.

Figure 8B:
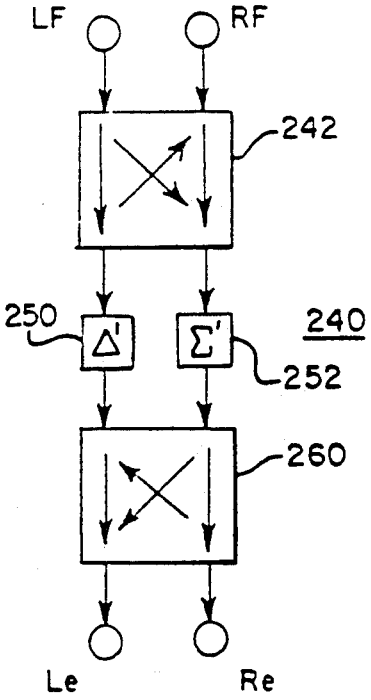

FIG. 8B is a generalized block diagram of the same embodiment illustrated in FIG. 8A, wherein the difference-sum forming networks are each represented as single blocks.

Figure 9:
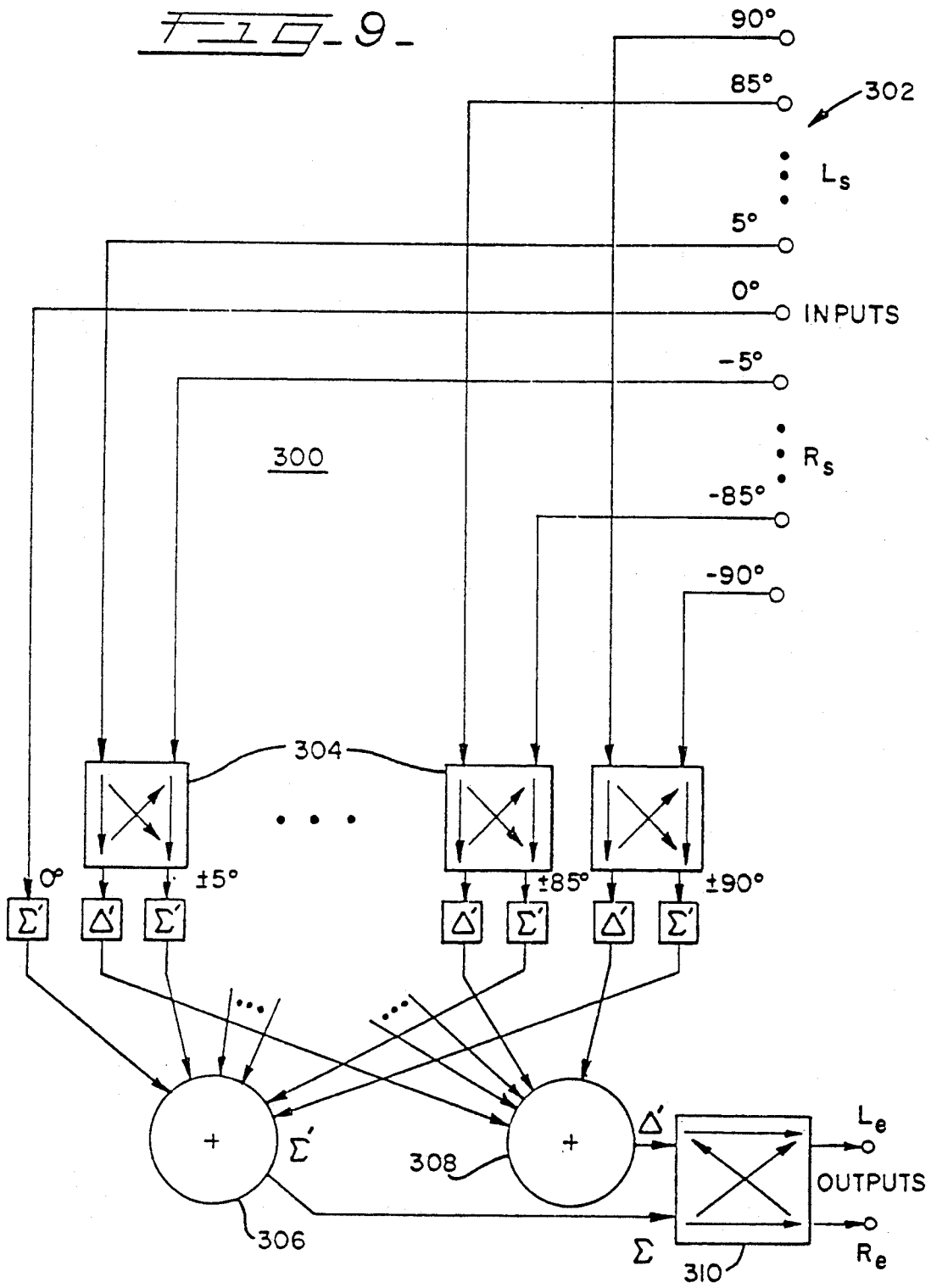

FIG. 9 is a generalized block diagram illustrating a specific embodiment of a multiple shuffle-circuit formatter functioning as a synthetic head.

FIG. 10A is a generalized block diagram illustrating a specific embodiment of a reformatter to convert signals intended for presentation at one speaker angle (e.g., ±30°) to signals suitable for presentation at another speaker angle (e.g., ±15°), employing two complete shuffle-circuit formatters.

FIG. 10B is a generalized block diagram illustrating a specific embodiment of a reformatter for the same purpose as in FIG. 10A, but using only one shuffle-circuit formatter.

FIG. 11 is a generalized block diagram illustrating a specific embodiment of a reformatter to convert signals intended for presentation via one loudspeaker layout to signals suitable for presentation via another layout, particularly one with an off-side listener closely placed with respect to one of the loudspeakers.

Figure 12:
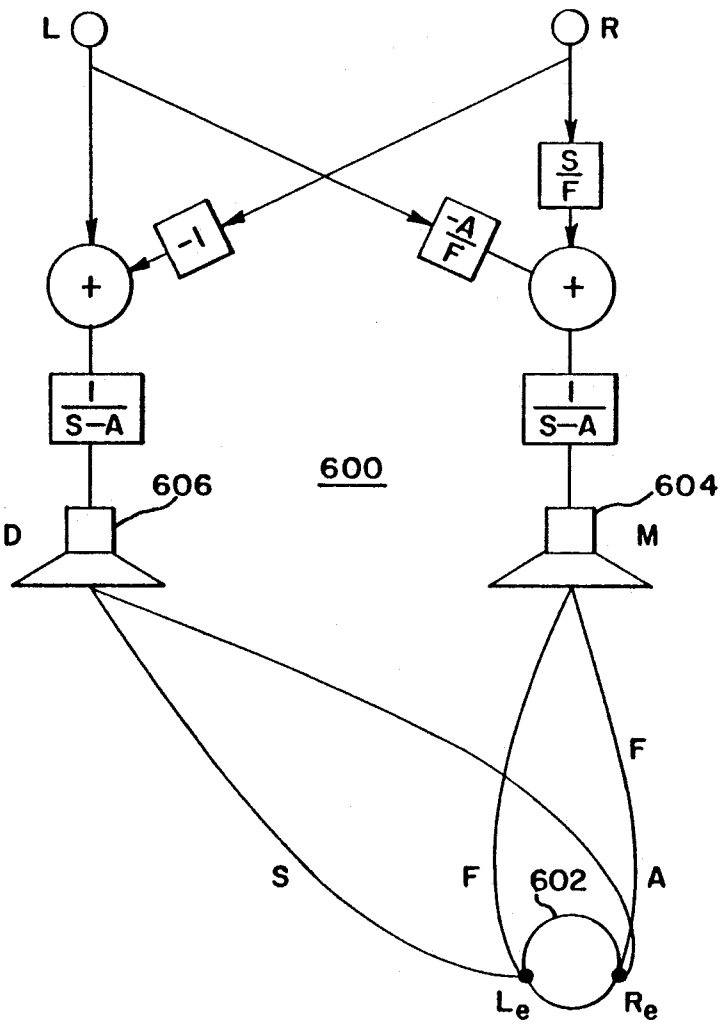

FIG. 12 is a generalized block diagram illustrating a specific embodiment of a stereo audio processing system for an unsymmetric loudspeaker-listener layout according to the invention.

Figure 13:
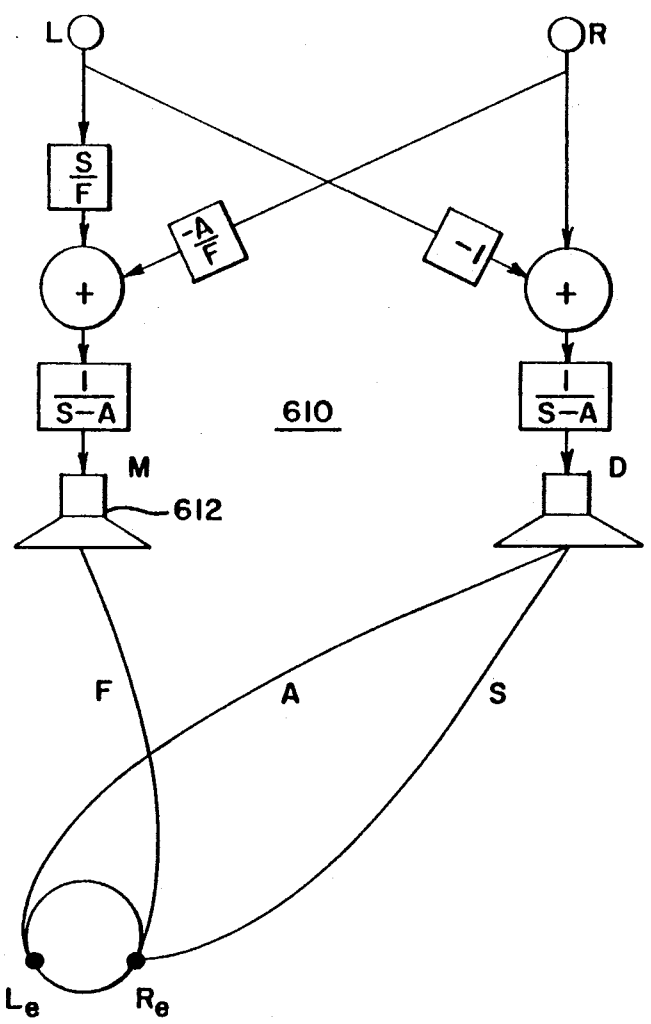

FIG. 13 is a generalized block diagram illustrating another specific embodiment of a stereo audio processing system for an unsymmetric loudspeaker-listener layout according to the invention.

Figures 14, 15:
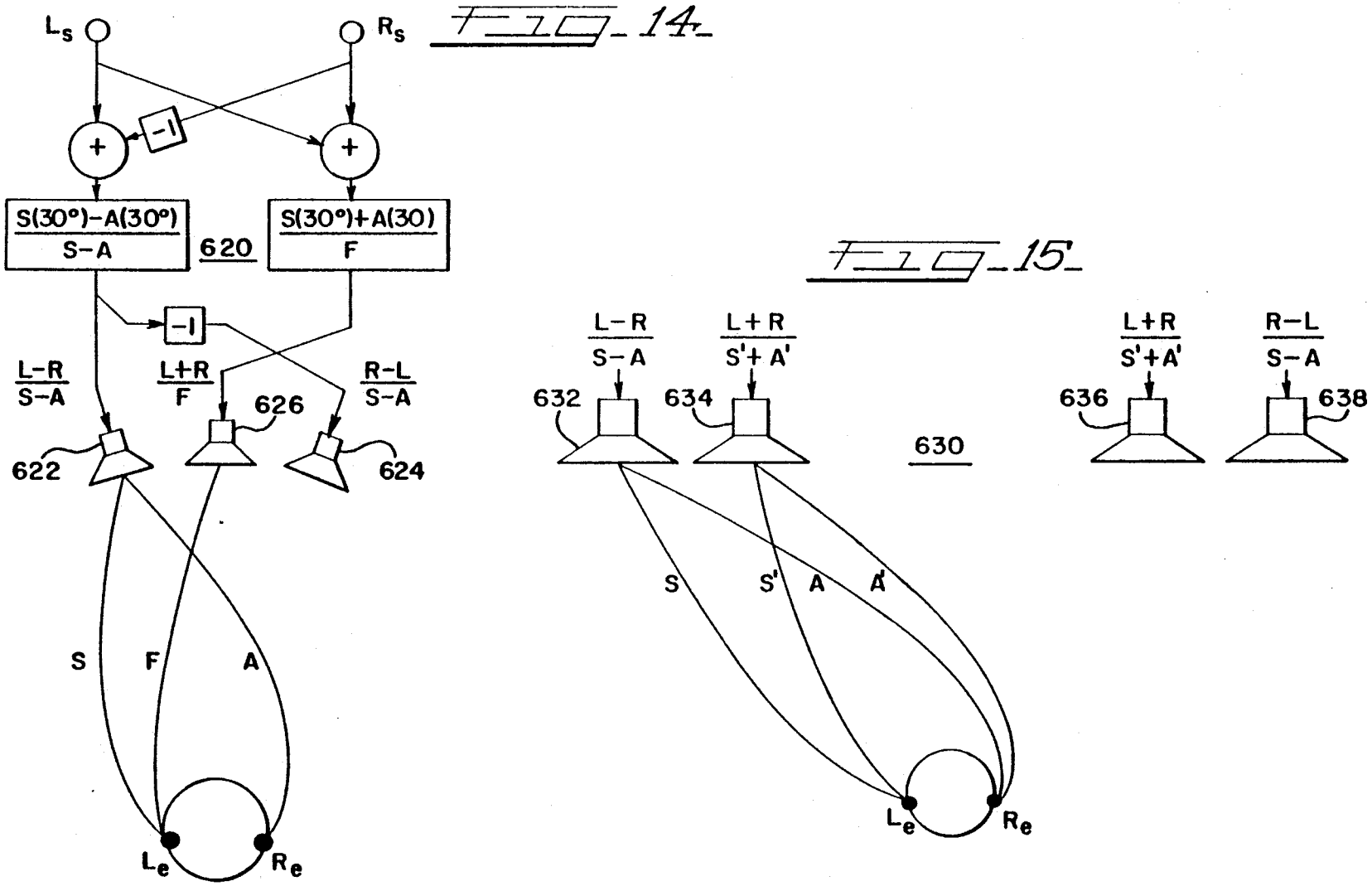

FIG. 14 is a generalized block diagram illustrating a specific embodiment of a reformatter for a symmetric three-loudspeaker layout according to the invention.

FIG. 15 is a generalized block diagram illustrating signals in a specific embodiment of a stereo audio processing system for a symmetric four-loudspeaker layout according to the invention.

Figure 16A:
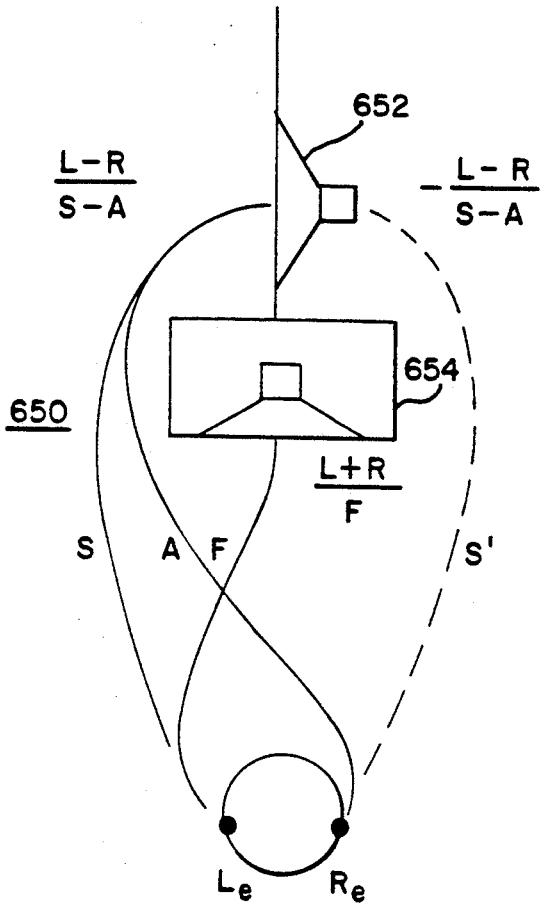

FIG. 16A is a generalized block diagram illustrating signals in a specific embodiment of a stereo audio processing system for a symmetric dipole-monopole loudspeaker layout according to the invention.

Figure 16B:
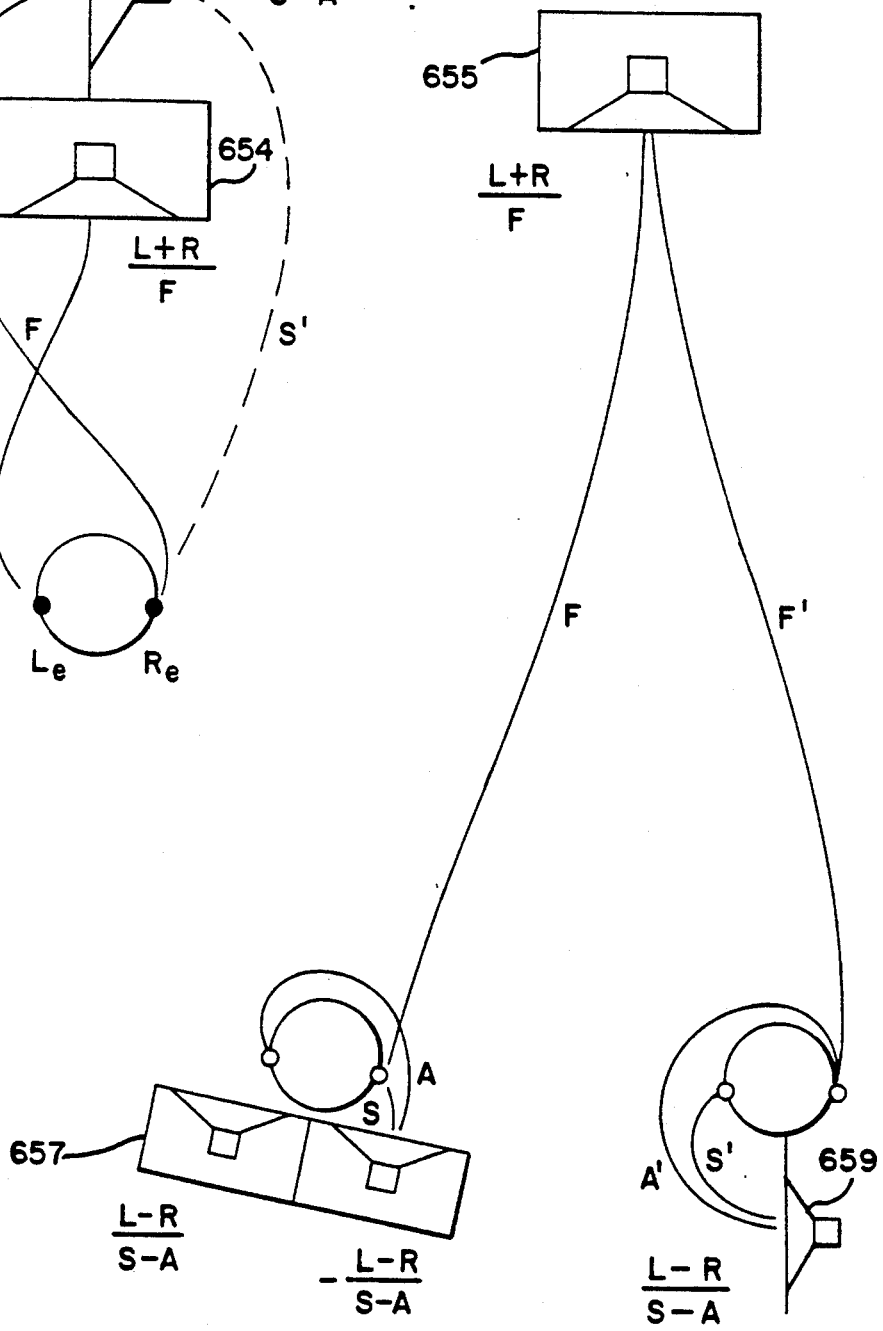

FIG. 16B is a generalized block diagram illustrating signals in a specific embodiment of a stereo audio processing system for a symmetric dipole-monopole loudspeaker layout in which a mono-sum component is projected from in front of a listener at an appreciable distance with a stereo-difference component being projected by a dipole transducer close to the listeners ears in an arrangement that may be replicated for many listeners according to the invention.

Figure 17:
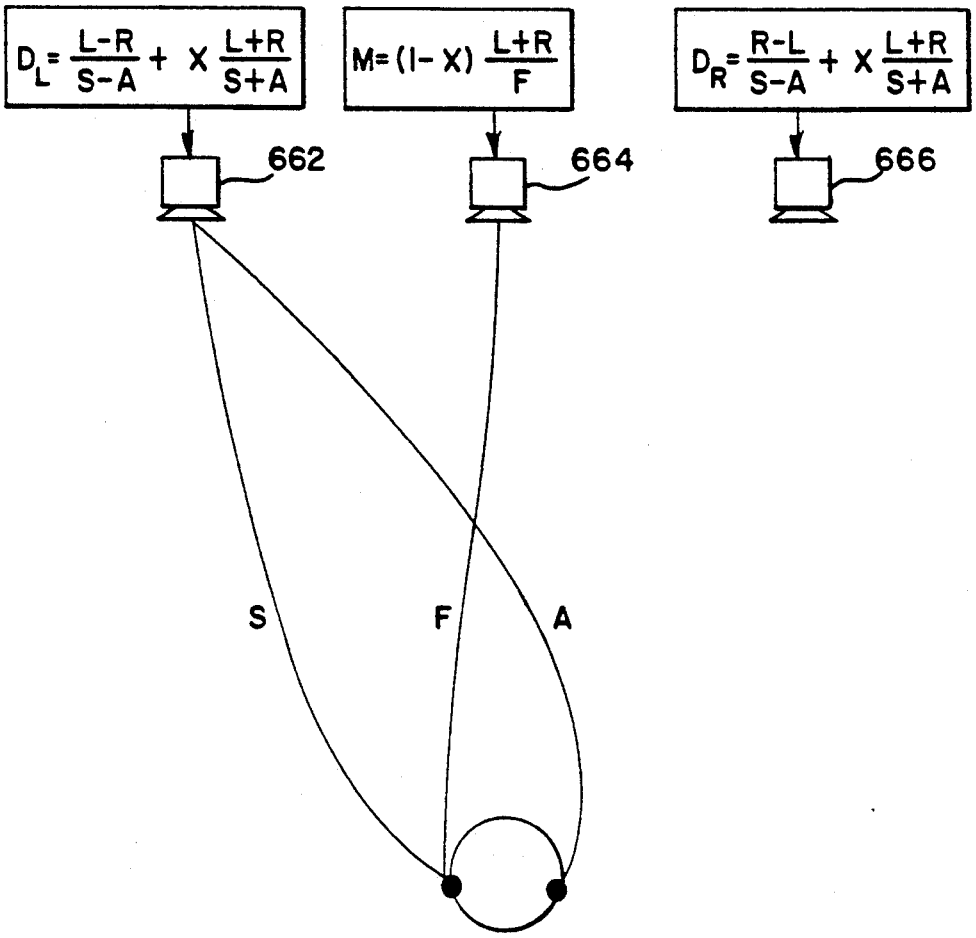

FIG. 17 is a generalized block diagram illustrating signals in a specific embodiment of a stereo audio processing system for a symmetric three-loudspeaker layout in which a mono-sum component may be distributed in varying proportions specified by a parameter x according to the invention.

Figure 18:
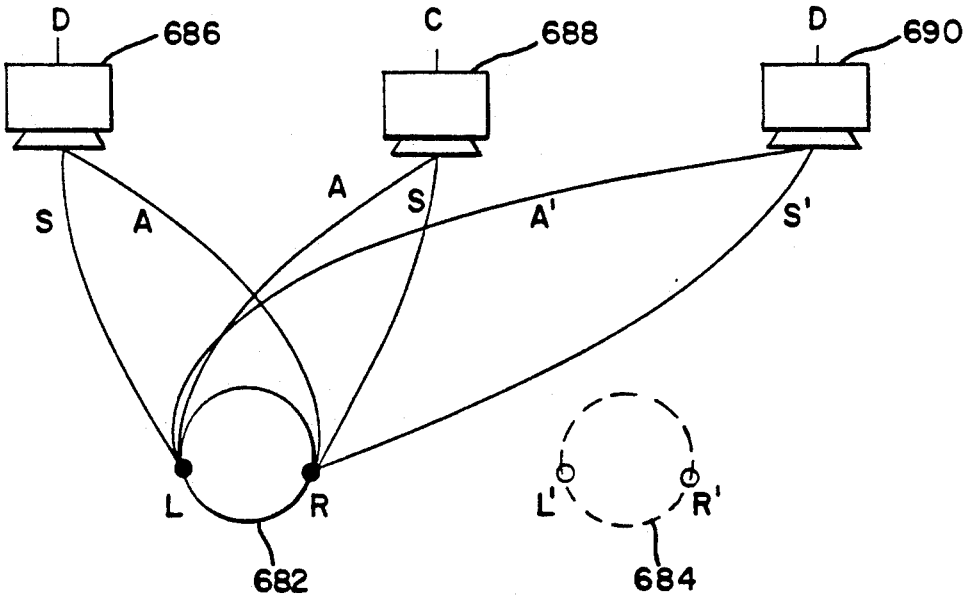

FIG. 18 is a generalized block diagram illustrating signal paths for a specific embodiment of a stereo audio processing system in a symmetric three-loudspeaker layout in which a provision is to be made for a second listener according to the invention.

DETAILED DESCRIPTION OF THE PREFERRED EMBODIMENT

FIG. 1A is a generalized block diagram illustrating a specific embodiment of a stereo audio processing system 50 according to the invention. The stereo system 50 comprises an artificial head 52 which produces two channels of audio signals which are coupled to a lattice network 54, as shown. The signals from the artificial head 52 may be coupled to the network 54 by first recording the signals and then reproducing them and coupling them to the network 54 at a later time. The artificial head 52 comprises a physical dummy head, which may be a spherical head in the illustrated embodiment, including appropriate microphones 64, 66. The artificial head may also be a replica of a typical human head using head dimensions representative of middle values for a large population. The output of the microphones 64, 66 provide audio signals having head-related transfer functions imposed thereon. The lattice network 54 provides crosstalk and naturalization compensation thereby processing the signals from the artificial head 52 to compensate for actual acoustical propagation path and head-related distortion.

The artificial head may alternately comprise a natural, living head whose ears have been fitted with miniature microphones, or it may alternately comprise a synthetic head. The synthetic head, to be described in detail at a later point in connection with FIG. 9, comprises an array of circuits simulating the signal modifying effects of head-related diffraction for a discrete set of source signals each designated a specific source bearing angle. The signals from such a head, or alternate, are each coupled to the network 54 which comprises filter circuits (S'G) 72, 74, crosstalk filters (A'F) 76, 78, and summing circuits 80, 82, configured as shown. The outputs of the network 54 are coupled to the loudspeakers 60 and 62, which are placed at a bearing angle $\phi$ (typically $\pm 30°$) for presentation to a listener 84, as shown. In one embodiment of the system 50, the summed signals at the summing circuits 80 and 82 may be recorded and then played back in a conventional manner to reproduce the processed audio signals through the loudspeakers 60 and 62.

Figure 1B:
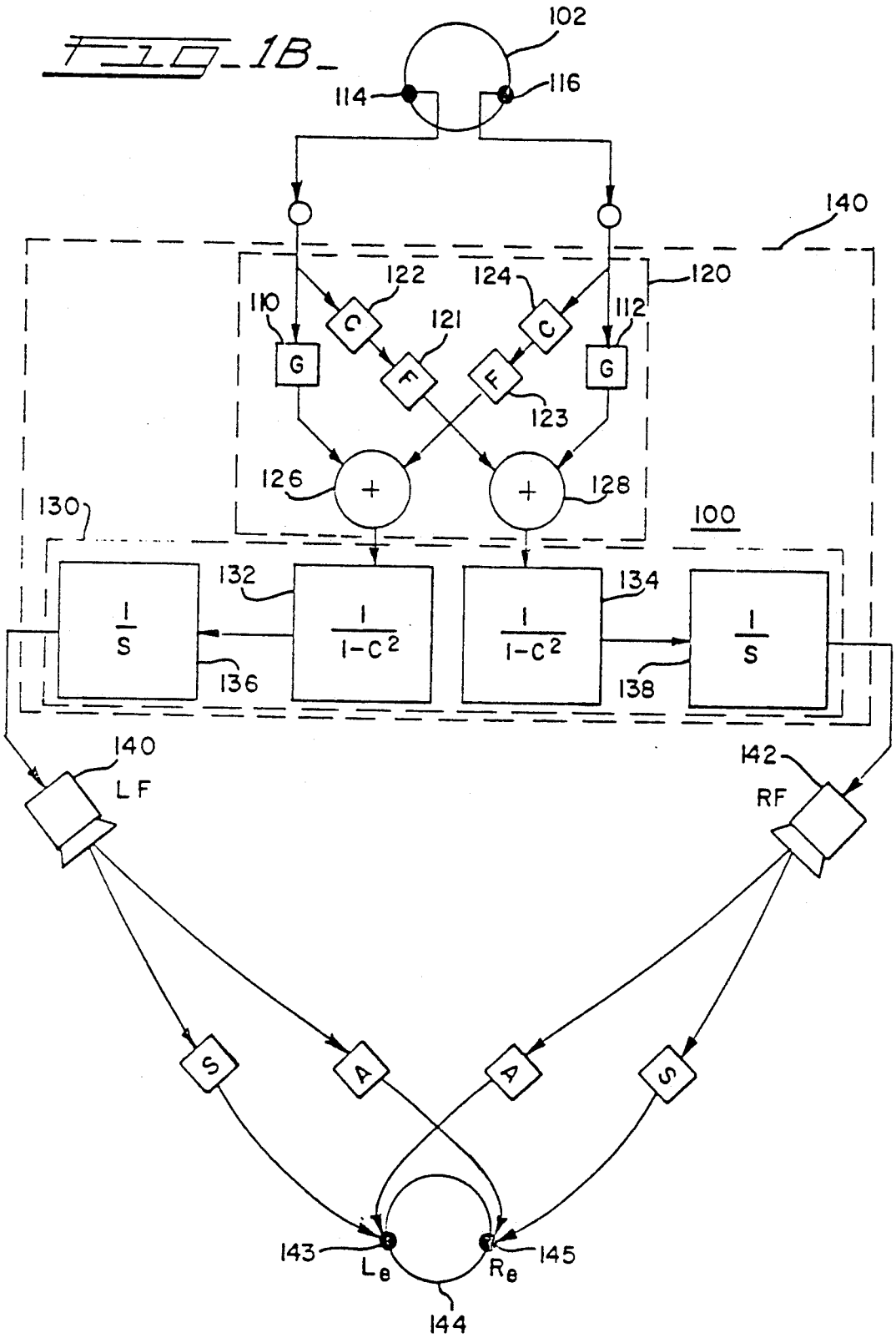
FIG. 1B is a generalized block diagram illustrating another specific embodiment of a stereo audio processing system according to the invention.

An alternative embodiment of a stereo audio processing system according to the invention is illustrated in generalized block diagram form in FIG. 1B. In the embodiment of FIG. 1B, the stereo audio processing system 100 comprises an artificial head 102 or alternative heads as indicated above in connection with FIG. 1A. The artificial head 102 is coupled, either directly or via a record/playback system to a compensation network 140 which comprises a crosstalk cancellation network 120 and a naturalizing network 130. The crosstalk cancellation network 120 comprises two crosstalk circuits 122 and 124 which impose a transfer function $C=-A/S$, where S is the transfer function for the acoustical propagation path characteristics from one loudspeaker to the ear on the same side, and A is the transfer function for the propagation path characteristics to the ear on the opposite side, as shown.

Each crosstalk circuit 122, 124 is substantially limited to frequencies substantially below ten kilohertz by low pass filters 121 and 123 with response characteristic F having cutoff frequency substantially below ten kilohertz. The output of the crosstalk filter circuits 121, 123 is summed with the output modified by the filters (G) 110, 112, by the summing circuits 126, 128, of the opposite channel, as shown. The resulting signals are coupled respectively to crosstalk correction circuits 132 and 134 which impose a transfer function of $1/(1-C^2)$. The resulting signals are coupled to the naturalization circuits 136 and 138 which impose a transfer function of 1/S, as shown. The output of the network 130 is then coupled, optionally via a recording/playback system, to a set of loudspeakers 140 and 142 for presentation to the ears 143, 145 of a listener 144, as shown.

FIG. 1C is a generalized block diagram of another alternative embodiment of a stereo audio processing system according to the invention. The stereo audio processing system of FIG. 1C comprises an artificial head 151 comprising two microphones 152, 154 for generating two channels of audio signals having head-related transfer functions imposed thereon. A synthetic head, which is described in greater detail hereinafter with reference to FIG. 9, may alternatively be used. The audio signals from the artificial or synthetic head 151 are coupled, either directly or via a record/playback system, to a shuffler circuit 150, which provides crosstalk cancellation and naturalization of the audio signals.

The shuffler circuit 150 comprises a direct crosstalk channel 155 and an inverted crosstalk channel 156 which are coupled to a left summing circuit 158 and a right summing circuit 160, as shown. The left summing circuit 158 sums together the direct left-channel audio signal and the inverted crosstalk signal coupled thereto, and couples the resulting sum to a Delta ($\Delta$) filter 162. The right summing circuit 160 sums the direct right-channel signal and the direct crosstalk left channel signal and couples the resulting sum to a Sigma ($\Sigma$) filter 164. The output of the Delta filter 162 is coupled directly to a left summing circuit 166 and an inverted output is coupled to a right summing circuit 170, as shown. The output of the Sigma filter 164 is coupled directly to each of the summing circuits 166 and 170, as shown. The output of the summing circuits 166 and 170 is coupled, optionally via a record/playback system to a set of loudspeakers 172 and 174 arranged with a preselected bearing angle $\phi$ for presentation to the listener 176.

Each of the three alternative embodiments may be shown to be equivalent. For the purposes of explaining the overall functioning of these configurations, let the filters F and G of FIGS. 1A and 1B be regarded as nonfunctioning, i.e., to have a frequency-independent transmission function of unity. (The purpose and design of these filters or alternative equivalents will be described in detail hereinafter). Then, if the transfer function through the direct path (through G) in FIG. 1B is computed, it is found to be $(1/S)/(1-C^2)$, equivalent to $S'=S/(S^2-A^2)$, to obtain a loudspeaker signal. Similarly, if the transfer function through the cross path (through F) is computed, it is found to be $(C/S)(1-C^2)$, equivalent to $A'=-A/(S^2-A^2)$, to obtain a loudspeaker signal. These S' and A' transfer functions are the same functions used in FIG. 1A, and the same result would have been obtained if the F and G symbols had been carried along in the computation. The equivalence may be extended to FIG. 1C by requiring the Delta filter to be equal to $(S'-A')/2$ and requiring the Sigma filter to be equal to $(S'+A')/2$, which are $(\frac{1}{2})(S-A)$ and $(\frac{1}{2})(S+A)$, respectively, and there is little difficulty in carrying the F and G symbols through the derivation also. The factor $\frac{1}{2}$ may be omitted in these equations, neglecting a 6 dB uniform level shift, permitting, for the purposes of analysis, the delta filter characteristic to be written as $1/(S-A)$, and the sigma filter characteristic to be written as $1/(S+A)$.

Thus, an explanation of the functioning of any one of these embodiments will illustrate the functioning of them all. Referring to FIG. 1B, for example, where the acoustic-path transfer functions A and S are explicitly shown, it may be seen that the left ear signal at $L_e$ 143 is derived from the signal at the microphone 114 via the transfer function $S^2/(S^2-A^2)$ involving path S, to which must be added the transfer function $-A^2/(S^2-A^2)$ involving path A, with the result that the transfer function has equal numerator and denominator and is thus unity. However, a corresponding analysis shows that the transfer function from the signal at the microphone 116 to the same ear, $L_e$ 143 is $AS/(S^2-A^2)$ to which must be added $--A^2)$, thus obtaining a null transfer function. This analysis illustrates crosstalk cancellation whereby each ear receives only the signal intended for it despite its being able to hear both loudspeakers.

The embodiment of FIG. 1B, except for the F and G filters, was described by M. R. Schroeder in the American Journal of Physics, vol. 41, pp. 461–471 (April 1973), "Computer Models for Concert Hall Acoustics," FIG. 4, and later in the Proceedings of the IEEE, vol. 63, p. 1332–1350 (Sep. 1975) "Models of Hearing," FIG. 4. Earlier equivalent versions may also be seen in B.S. Atal and M.R. Schroeder, "Apparent Sound Source Translator," U.S. Pat. No. 3,236,949 (Feb. 26, 1966).

However, the embodiment of FIG. 1B will be inoperative if the various filter functions specified therein cannot be realized as actual signal processors. The question of realizability may be examined with the help of FIGS. 2A and 2B, plots of the acoustic transfer functions S and A in magnitude and phase, respectively, for a spherical-model head. Plots for a more realistic model will differ from these only in details not relevant to realizability. Schroeder taught that the filter $C=-A/S$ would be realizable, having a magnitude sloping steeply downward with increasing frequency, and similarly for the phase, indicating a substantial delay. The corresponding finite impulse response calculated by Fourier methods would show a characteristic pulse shape substantially delayed from the time of application of the impulse. The fulfillment of this causality condition is of the essence of realizability. Such an impulse response may be realized as a transversal filter. Schroeder saw that the filter $C^2$ would also be realizable as a transversal filter, and that placement of $C^2$ in a feedback loop would produce the realization of $1/(1-C^2)$. The remaining filter, 1/S, however, would not be directly realizable because Schroeder's data, contrary to FIG. 2B, showed 1S to exhibit a rising phase response being indicative of an advance, with calculation by Fourier methods showing a characteristic pulse response beginning prior to the application of the impulse. Nevertheless, it was realized that providing a frequency-independent delay that would be equal in the two loudspeaker channels would be harmless, so that a transversal-filter realization employing augmented delay would be satisfactory for 1/S.

Figure 2D:
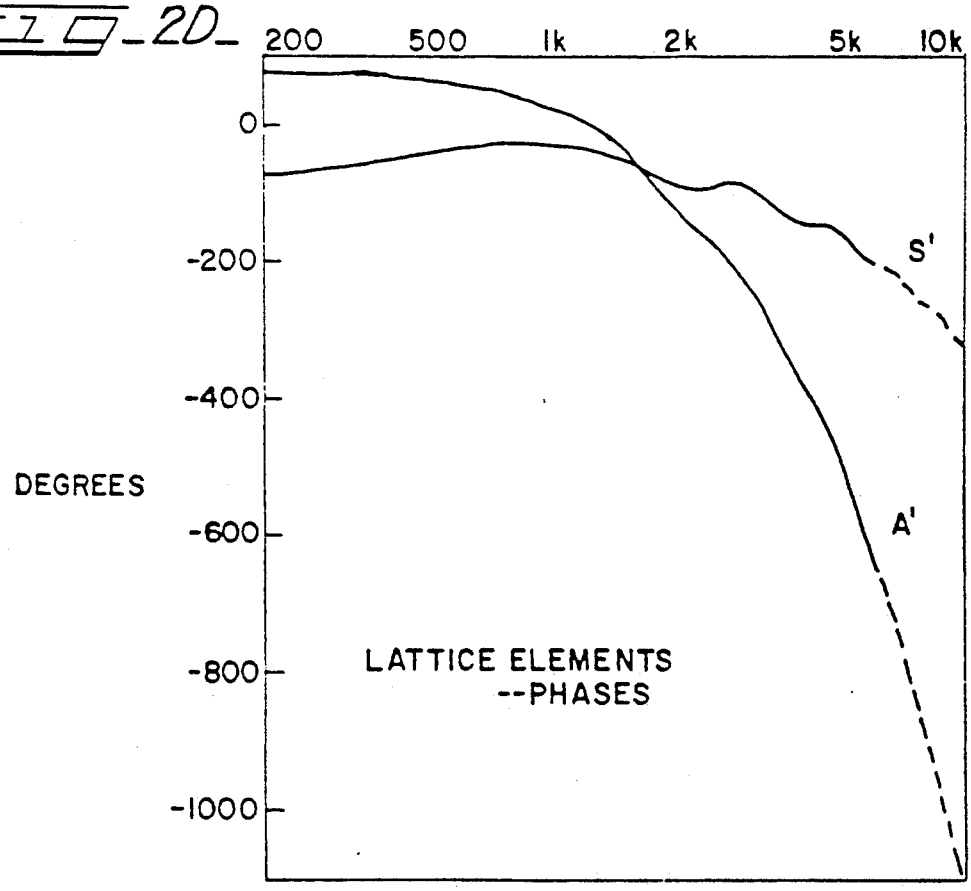
FIG. 2D is a set of phase-(degrees)-versus-frequency-(log scale) response curves of the transfer characteristics of the filters shown in FIG. 1A, filters S' and A', but omitting the phase consequences of the factors G and F, and showing in dashed line the frequency region in which the magnitude modifications are made, used in explaining the invention.

The filter S' and A' of FIG. 1A have the transfer functions shown plotted in FIG. 2C for magnitude and in FIG. 2D for phase, from spherical-model calculations. Specific curves for S' and A' are represented by the solid-line curves with dashed-line continuation, while the solid line continuations show modifications imposed by the filter factor G, forming S'G, and imposed by the filter factor F forming A'F, the filters shown in FIG. 1A. However, the corresponding phase modifications are not shown in FIG. 2D, such further information not being required at this point.

It may be seen from these unmodified curves that the S' and A' filters are realizable because of the steep downward slopes with increasing frequency in the phase, indicating abundant delay to allow realization by transversal filters. Of course, if more delay were needed for that purpose, it would be harmless to provide equal increments in delay for each. In the configuration used by Schroeder and Atal, the filters to be realized are more nearly directly related to measurable data, S and A, and one may always proceed with the greater confidence the closer one stays to measured data in its original form. Nevertheless, the requisite filters are realizable, so that FIGS. 1A and 1B show equally acceptable configurations.

The rather large amounts of delay involved in the filters for both of the configurations of FIGS. 1A and 1B, however, make them awkward for realization by means other than transversal filters or other devices capable of generating longer delays. Other means of realization, or synthesis, are much less troublesome and expensive if the filters to be synthesized are of the kind known as "minimum phase" because then simpler network structures may be used with efficient, more widely-known synthesis techniques. Minimum-phase filters have the property that the phase response may be calculated directly from the logarithm of the magnitude of the transfer function by a method known as the Hilbert transform. If the transfer function is not of minimum phase, the calculation results in only a part of the phase response, leaving an excess part that is the phase response of an all-pass factor in the transfer function. Although many examples of all-pass filters are known, the synthesis of the phase response of an arbitrarily-specified all-pass filter is not as well developed an art as the synthesis of minimum-phase filters.

It is known in the art that the excess phase in the transfer functions A and S is nothing more than a frequency-independent delay (or advance). Thus, the Schroeder filters C and 1/S could have been realized as minimum-phase filters together with a certain frequency-independent increment in delay, since products and ratios of minimum-phase transfer functions are also of minimum phase. However, it does not follow that $1-C^2$ would be of minimum phase. Thus, the phase status of A' and S' does not follow. The difference between two properly-chosen, minimum-phase transfer functions is one means of synthesizing an all-pass transfer function.

However, it is one aspect of the invention to teach the use of minimum-phase filter synthesis in these systems. The inventors have been able to show that the transfer functions $S+A$ and $S-A$ have a common excess phase that is nothing more than a frequency-independent delay (or advance). Since the product of these is $S^2-A^2$, all of the filters considered thus far may be synthesized as minimum-phase filters, together with appropriate increments in frequency-independent delay.

This provides a distinct advantage since such augmentation is available through well-known means.

It is a further aspect of the invention to teach limiting the frequency response of the crosstalk canceling filters A' to form A'F. The modification shown as the solid-line continuation in FIG. 2C illustrates the general form of such modifications delegated to the filter function F. The reason for limiting frequency response is that cancellation actually takes place at the listener's ears and it is reasonably exact in a region of space near each ear, a region that is smaller for the shorter wavelengths. Thus, if the listener should turn his head, his ear will be less seriously transported out of the region of nearly exact cancellation if the cancellation is limited to the longer wavelengths. Schroeder reports some 10° as the maximum allowable rotation, and some 6 inches as the maximum allowable sideways movement for his system. It is a teaching of this invention that limiting the response of the crosstalk canceling filter to a frequency substantially below 10 KHz will still allow accurate image portrayal over a wide enough frequency band to be quite gratifying while allowing the listener to move over comfortable ranges without risking serious impairment of the illusion. Experiments with an embodiment of the system illustrated in FIG. 1C confirm the correctness of this teaching.

The solid-line extension for curve S' in FIG. 2C illustrates one possible effect to be produced by the filter G of FIGS. 1A and 1B. When the acoustic transfer functions are determined from the spherical model of the head, as used here for illustration, then the undulations determined for S' will not be the same as they would be for a more realistic model, especially at the higher frequencies. In accordance with the invention, the filter will not simulate the details of these undulations above a certain frequency. However, there is another reason not to simulate the higher-frequency undulations: listeners' heads will vary in ways that are particularly noticeable in measurements at the higher frequencies, especially in the response functions attributed to the pinna. Thus, above a certain frequency, it would not be possible to represent these undulations correctly, except for a custom-designed system for a single listener. A correct simulation of these undulations will, however, affect only the tone quality at these higher frequencies, frequencies for which the notion of "tone" becomes meaningless. It is sufficient to obtain the correct average high-frequency level, and dispense with detail. The solid-line extension of S' in FIG. 2C illustrates filter characteristics for one embodiment of the invention, and is characteristic of a system, as illustrated in FIG. 1C, which the inventors have constructed and with which they have made listening tests.

It is therefore to be seen that there are two reasons for limiting the crosstalk cancellation to frequency ranges substantially less than 10 KHz. The first reason is to allow a greater amount of listener head motion. The second reason is a recognition of the fact that different listeners have different head-shape and pinna (i.e., small-scale features), which manifest themselves as differences in the higher-frequency portions of their respective head-related transfer functions, and so it is desirable to realize an average response in this region.

Plots of the magnitude of the transfer functions Delta of FIG. 1C, namely $1/(S-A)$, and of Sigma, namely $1/(S+A)$, are shown in solid line in FIG. 3A. There, the dashed-line continuation shows the transfer function specified in terms of S and A in full for the spherical model of a head, and the solid-line shows the transfer function approximated in the system of FIG. 1C. The consequence of the modification illustrated in FIG. 3A is, in fact, the modification illustrated in FIG. 2C. The means whereby these transfer functions were realized will be discussed at a later point. It is seen that the modification in FIG. 3A consists in requiring a premature return to the high-frequency asymptotic level (−6 dB), premature in the sense of being completed as soon as possible, considering economies in realization, above about 5 KHz.

The curve Delta in FIG. 3A shows an integration characteristic, a −20 dB-per-decade slope that would intercept the −6 dB asymptotic level at about 800 Hz, with a beginning transition to asymptotic level that is modified by the insertion of a small dip near 800 Hz, and a similar dip near 1.8 KHz, after which there begins a relatively narrow peak characteristic at about 3.3 KHz rising some 7 dB above asymptotic, falling steeply back to asymptotic by about 4.5 KHz, followed by a small dip near 5 KHz, after which there is a rapid leveling out (solid-line continuation), at higher frequencies towards the asymptotic level. The curve Sigma in FIG. 3A shows a level characteristic at low frequencies that lies at the asymptotic level, followed by a gradual increase that reaches a substantial level (some 4 dB) above asymptotic by 800 Hz and continues to a peak at about 1.6 KHz at some 9.5 dB above asymptotic, after which there is a steep decline to asymptotic level at about 2.5 KHz, a small dip at about 3.5 KHz, followed by a narrow peak of some 6 dB at about 5.0 KHz, followed by a relatively steep decline to reach asymptotic level at about 6.3 KHz that is modified (solid-line continuation), beginning at about 6.0 KHz, to begin a rapid leveling out to the asymptotic level at higher frequencies.

The system of FIG. 1C also included a high-pass modification of these curves at extreme low frequencies, primarily to define a low-frequency limit for the integration characteristics of the Delta curve. The same high-pass characteristic is used for Sigma also, for the sake of equal phase fidelity between the two curves. Although a 35-Hz high-pass corner was chosen, in common, any in the range of approximately 10 Hz to 50 Hz would be very nearly equally satisfactory.

It is a teaching of this invention that these curves may be modified to approximate Delta and Sigma in a variety of ways, described below as alternative treatments of specifications of F and G for specific purposes. It is to be understood, however, that other modifications that result in curves following generalized approximations to the curves of FIG. 3A, or any of the curves thereafter, including approximations to the high-frequency trends, whether for the spherical-model head, or replica of a typical human head, or any other model, and including consequences of such generalized approximations for the filters of FIGS. 1A and 1B, fall within the teachings of this invention.

The curves shown in FIG. 3B illustrate means of obtaining an alternate G-filter effect mentioned above. It is seen that the solid-line extension for Delta is made to join with the solid-line curve for Sigma as soon as reasonable after 5 KHz, but that the Sigma curve is unmodified. Thus the difference between the two curves quickly approaches null, as shown in FIG. 3C by the trend in A'F towards minus infinity decibels. Thus F is as before, but it is also seen that S'G is the same as S', i.e., G is unity. As mentioned before, this alternative would be useful in custom-designed formatters.

Another alternative treatment of G is illustrated in FIG. 4A. There, the premature return to a high-frequency level is to a level some 2 dB higher than asymptotic. The result is an elevated high-frequency level for S'G, as illustrated in FIG. 4B, while A'F shows the same high-frequency termination as previously indicated.

Inspection of FIG. 4A suggests a lower-frequency opportunity for premature termination to a high-frequency level, namely at about 2.5 KHz. By forcing the Delta and Sigma curves to follow the same function above such frequency, the cut-off frequency for low-pass filter F will, in effect, be determined to lie at about 2.5 KHz, while the character of G will be determined by the alternative chosen for the character of the common function to be followed above 2.5 KHz. Restriction of the crosstalk cancellation to such low frequencies will make the imaging properties more robust (i.e., being less vulnerable to listener movement). The price to be paid for such augmented robustness is, of course, a diminishment in imaging authenticity.

However, a more general means to limit the frequency range of crosstalk canceling, one more general than the ad hoc process of looking for a propitious opportunity indicated by the curve shapes is illustrated in FIG. 4C. Indicated in FIG. 4C as a solid line is an approximation departing from the full specification, departures covering a broad range of frequencies, beginning with small departures at the lower frequencies, undertaking progressively larger departures at higher frequencies. Useful formatters may be constructed by such means, useful particularly to provide a more pleasing experience for badly-placed listeners that might thus perceive an untoward emphasis upon certain frequencies.

The specific filter responses used in constructing a test system as shown in FIG. 1C are illustrated in FIGS. 5A through 5D. These FIGS. 5A–5D show computer-generated plots of the spherical-model diffraction specifications in dashed line and plots of the accepted approximations in solid line. A computer was programmed to make the diffraction calculations and form the dashed line plot. However, it was also programmed to calculate the frequency response of the combination of filter elements to be constructed in realizing the filters and in making the solid-line plots. Then, the operator adjusted the circuit parameters of the filter elements to obtain close agreement with the diffraction calculations up to about 5 KHz. The filter thus designed was chosen to be a minimum-phase type. It was found that it is possible to obtain a simultaneous match for both the amplitude and the phase response except for an excess phase corresponding to nothing more than a frequency-independent delay (or advance). Since filters $1/(S-A)$ and $1/(S+A)$ were being approximated, these were thus established as of minimum phase, at least over the frequency range explored.

FIG. 5A illustrates the extent of agreement between diffraction specification and accepted design for the magnitude of Delta, plotted in decibels versus frequency (log scale), and FIG. 5B illustrates the simultaneous agreement in phase. The latter is actually a plot of phase slope, or frequency-dependent delay in microseconds, versus the same frequency scale. Agreement in phase slope is at least equal in significance as agreement in phase, but is of advantage in sensing a disagreement in frequency-independent delay (or advance), and such uniform-with-frequency discrepancies were indeed found. Such discrepancies were found to be the same for both the Delta and Sigma filters and could thus be suppressed in the filter design. FIGS. 5C and 5D illustrate, respectively, curves similarly obtained for the Sigma filter.

FIG. 6A is a detailed block diagram illustrating a specific embodiment of the system of FIG. 1C. Operational amplifiers (op amps) of Texas Instruments type TL 074 (four amplifiers per integrated-circuit-chip package) were used throughout. The insertion of input, high-pass filters (35 Hz corner) is not shown. In FIG. 6A, input signals are coupled from inputs 154, 156 to summing circuits 158, 160 and each input is cross coupled to the opposite summing circuit with the right input 156 coupled through an inverter 162, as shown. An integrator 172 is placed in a Delta chain 170 as required at low frequencies, while inverters 173, 182 are inserted in both Sigma and Delta chains 170, 180. In these chains, a signal-inversion (polarity reversal) process happens at several places, as is common in op-amp circuits, and the inverters may be bypassed, as needed, to correct for a mismatch of numbers of inversions. The signals from the inverters 173, 182 are coupled to a series of BQ circuits (Bi-quadratic filter elements, also known as biquads) 174 and 184. The resulting signals are thereafter coupled to output difference-and-sum forming circuits comprising summing circuits 190, 192 and an inverter 194.

FIG. 6B is a generalized redrawing of FIG. 6A suppressing the showing of individual BQ (biquad) filter elements. The input circuit elements 154–162, the integrator 172, and the output elements 190–194 are the same as in FIG. 6A. However, the inverter 173 and the BQ elements 174 of FIG. 6A are represented by the single element 196 of FIG. 6B, and, similarly, the inverter 182 and the BQ elements 184 of FIG. 6A are represented by the single element 198 of FIG. 6B. The diagram emphasizes that the teachings of the invention are not restricted to specific choices of filter-synthesis elements or specific interconnection patterns. For example, it is known that the use of biquads as the filter-synthesis elements does not require the cascade pattern of interconnection, as in FIG. 6A, but also allows a parallel pattern of interconnection, often favored in low-noise work, in which the outputs of the BQs are brought to a common summing element for output. Combinations of cascade and parallel patterns may also be used. The design of the individual BQs should take due account of the interconnect pattern planned. Again, excellent approximations to the acoustic diffraction functions in sum-difference configuration may be made with minimum-phase filters. Nevertheless, the exclusion of nonminimum-phase filters is not required and the more general approach may provide as good or better result. Further, the use of biquads does not exhause the possibilities of all suitable filter elements, even though biquads are advantageous because of simplicity and convenience. By way of further example, it is also convenient to use IIR, or recursive, biquad filter elements in parallel connection pattern in digital designs. For all of these examples, the generalized FIG. 6B is the more representative.

As is generally known, biquads may be designed to produce a peak (alternative: dip) at a predetermined frequency, with a predetermined number of decibels for the peak (or dip), a predetermined percentage bandwidth for the breadth of the peak (or dip), and an asymptotic level of 0 dB at extreme frequencies, both high and low.

A specific embodiment of a suitable biquadratic filter element 200 is shown in FIG. 7. Other circuits for realizing substantially the same function are known in the art. The biquad circuit element 200 comprises an operational amplifier 202, two capacitors 204, 206 and six resistors 208, 210, 212, 214, 216, and 218 configured, as shown. With the circuit-element values shown, a peak at 1 kHz, of 10 dB height, and a 3 dB bandwidth of 450 Hz will be characteristic of the specific embodiment shown. Design procedures for such filter elements are well known in the art. Digital biquadratic filters are also well known in the digital signal-processing art.

Attention is again directed to the integrator 172 of FIG. 6B. It is a filter element of a specific kind, obeying, as an analogue filter, the transfer function $I=(s+s_o)/s$, in which $s=2\pi jf$ and $s_o=2\pi f_o$. (I obeys $f_o/jf$ for $f<<f_o$, but unity transmission at zero phase for $f>>f_o$.) For one crosstalk canceler, for example, the design has $f_o=810$ Hz, marking the upper-frequency terminus, or 3-dB corner, of the integrator. (A lower corner, arbitrarily at 35 Hz, was also chosen as a matter of practical convenience, a corner not shown in the formula.) The insertion of such an integrator as a separate design act prior to the design of the remaining difference filters is advantageous. As a result all of the remaining filter elements can be treated as all of one kind, there remaining only biquad parameters to adjust, and for which to calculate the response, etc., and one integrator corner to adjust, jointly with the other parameters. The insertion of the integrator, then, allows a freedom of choice for the other elements, for interconnect style, for parameter adjustment procedures, etc. The same approach is valuable in digital designs as well.

A requirement for insertion of an integrator is known in the art. However, the prior art did not teach crosstalk canceling nor specify further difference filtering, beyond transmission at zero phase and unity gain, and the same for sum filtering.

FIG. 6C shows a low-frequency shuffler 195 explicitly as the input section for a stereo audio signal processor in which the output section 197 is labeled as an "above-600-Hz crosstalk canceler," an even more generalized version of FIG. 6A. Thus, one embodiment of the invention uses a shuffler as the low-frequency part of a crosstalk canceler and completes the canceler at higher frequencies, above some 600 Hz. Thus, a more generalized version of the low-frequency shuffler may be used, including those not explicitly of sum-difference format; for example, using through filters of the form $1+I$ and cross filters of the form $1-I$, or using filters involving the use of feedback having the effect of inserting a zero-frequency pole in forming I, etc.

In another embodiment of the invention stereo audio processing systems designed in the shuffler format may be realized also in other interconnection patterns. Further, the higher frequency portion of a crosstalk canceler is a useful stereo audio signal processor, for example, in enhancing the stereo qualities of a pair of directional microphones whose directivity already provides sufficient signal difference at low frequency. Thus the use of a generalized shuffler with a generalized higher-frequency crosstalk canceler 197, in the manner of FIG. 6C provides one embodiment of the invention wherein the quotation of a bounding frequency such as 600 Hz is to be regarded as schematic The stereo audio processing system of the invention provides a highly realistic and robust stereophonic sound including authentic sound source imaging, while reducing the excessive sensitivity to listener position of the prior art systems. In the prior art systems, such as Schroeder and Atal, in which head-related transfer function compensation has been used, the entire audio spectrum (20 hertz to 20 kilohertz) was compensated and the compensation was made as completely accurate as possible. These systems produced good sound source imaging but the effect was not robust (i.e., if the listener moved or turned his head only slightly, the effect was lost). By limiting the compensation so that it is substantially reduced at frequencies above a selected frequency which is substantially below ten kilohertz, the sensitivity to the listener movement is reduced dramatically. For example, providing accurate compensation up to 6 kilohertz and then rolling off to effectively no compensation over the next few kilohertz can produce a highly authentic stereo reproduction, which is also maintained even if the listener turns or moves. Greater robustness can be achieved by rolling off at a lower frequency with some loss of authenticity, although the compensation must extend above approximately 600 hertz to obtain significant improvements over conventional stereo.

To obtain the binaural recordings to be processed, an accurate model of the human head fitted with carefully-made ear-canal microphones, in ears each with a realistic pinna may be used. Many of the realistic properties of the formatted stereo presentation are at least partially attributable to the use of an accurate artificial head including the perception of depth, images far to the side, even in back, the perception of image elevation and definition in imaging and the natural frequency equalization for each.

It may be also true that some subtler shortcomings in the stereo presentation may be attributable to the limitation in bandwidth for the crosstalk cancellation and to the deletion of detail in the high-frequency equalization. For example, imaging towards the sides and back seemed to depend upon cues that were more subtle in the presentation than in natural hearing, as was also the case with imaging in elevation, although a listener could hear these readily enough with practice. Many of the needed cues are known to be a consequence of directional waveform modifications above some 6 KHz, imposed by the pinna. It is significant that these cues survived the lack of any crosstalk cancellation or detailed equalization at such higher frequencies, a survival deriving from the depth of the shadowing by the head at such high frequencies so that such compensating means are less sorely needed.

The experience of dedicated "binauralists" is that almost any acoustical obstacle placed between 6-inch spaced microphones is of decided benefit. Such obstacles have ranged from flat baffles resembling table-tennis paddles, to cardboard boxes with microphones taped to the sides, to blocks of wood with microphones recessed in bored holes, to hat-merchant's manikins with microphones suspended near the ears. One may, of course, think of spheres and ovoids fitted with microphones. Each of these has been found, or would be supposed with justice, to be workable, depending upon the aspirations of the user. The professional recordist will, however, be more able to justify the cost of a carefully-made and carefully-fitted replica head and external ears. However, any error in matching the head to a specific listener is not serious, since most listeners adapt almost instantaneously to listening through "someone else's ears." If errors are to be tolerated, it is less serious if the errors tend toward the slightly oversize head with the slightly oversize pinnas, since these provide the more pronounced localization cues.

This head-accuracy question needs to be carefully weighed in designing formatters that involve simulating the effect of a head directly, as for the synthetic head to be described hereinafter. One approach is to use measured head functions for these formatters. Fortunately, the excess delay in (S−A) and (S+A), the needed functions, is that of a uniform-with-frequency delay (or advance). The measurements, for most purposes, need be only of the ear signal difference and of the ear-signal sum, for carefully-made replicas of a typical human head in an anechoic chamber, and for most purposes only the magnitudes of the frequency responses need be determined. This is fortunate, since the measurement of phase is much more tedious and vulnerable to error. Such phase measurements as might be advantageous in some applications, need be only of the excess phase, i.e., that of frequency-independent delay, against an established free-field reference.

An example of direct head simulation would be that of a formatter to accept signals in loudspeaker format with which to fashion signals in binaural format (i.e., an inverse formatter). FIG. 8A illustrates a specific embodiment of a head-simulation inverse formatter 240 including a difference-and-sum forming network 242 comprising summing circuits 244, 246 and an inverter 248 configured as shown. The difference and sum forming circuit 242 is coupled to Delta-prime filter 250 and a Sigma-prime filter 252, the primes indicating that the filter transfer functions are to be S−A and S+A, instead of their reciprocals. The outputs of the Delta-prime and Sigma-prime filters is coupled, as shown, to a second difference and sum circuit 260, as shown. The first appearance of an inverse formatter, or its equivalent may be found in Bauer, "Stereophonic Earphones and Binaural Loudspeakers," Jour. Acoust. Soc. Am., vol. 9. pp. 148–151 (April 1961), using separate S and A functions in approximation, showing a low-pass cutoff in A above about 3 KHz, and necessarily using explicit delay functions. See also Bauer, U.S. Pat. No. 3,088,997. It is an object of this aspect of the invention to improve upon Bauer by providing a more accurate head simulation, eliminating the low-pass cut for A, and avoiding the explicit use of delay by employing the shuffler configuration with Delta-prime and Sigma-prime filters. The use of faithful realizations of actual measured functions provides a further improvement. Since crosstalk cancellation is not a goal, there is no need for any kind of bandwidth limitation.

An accurate head simulator in this form is suitable for use with walk-type portable players using earphones. The conversion of binaurallymade, loudspeaker-format recordings back to binaural is highly suitable for such portable players. Questions of cost naturally arise in considering a consumer product, and particularly economical realizations of the filters are desirable and may be achieved by resorting to some compromise regarding accuracy and specifically using spherical model functions.

A block diagram of the inverse formatter 240 using an alternative symbol convention for the difference-and-sum-forming circuit is shown in FIG. 8B. Through the box symbol, the signal flow is exclusively from input to output. Arrows inside the box confirm this for those arrows for which there is no signal-polarity reversal, but a reversed arrow, rather than indicating reversed signal-flow direction, indicates, by convention, reversed signal polarity. Also by convention, the cross signals are summed with the direct signals at the outputs.

The above conventions are used, for compactness, in making a the generalized block diagram of a specific embodiment of a synthetic head 300 illustrated in FIG. 9. A plurality of audio inputs or sources 302 (e.g., from directional microphones, a synthesizer, digital signal generator, etc.) are provided at the top right each being designated (i.e., assigned) for a specific bearing angle, here shown as varying by 5° increments from −90° to +90°, although other arrays are possible. Symmetrically-designated input pairs are then led to difference-and-sum-forming circuits 304, each having a Delta-prime output and a Sigma-prime output, as shown. Each Sigma-prime output is coupled to a respective Sigma-prime filter and each Delta-prime output is coupled to a Delta-prime filter, as shown. The Delta-prime outputs are summed, and the Sigma-prime outputs are summed, by summing circuits 306, 308, separately and the outputs are then passed to a difference-and-sum circuit 310 to provide ear-type signals (i.e., binaural signals). The treatment of the 0°-designated input is somewhat exceptional because it is not paired, and the Sigma-prime filter for it is 2S(0°)=S(0°)+A(0°), determined for 0°, and its output is summed with that of the other Sigmas. In the diagram, ellipses are used for groups of signal-processing channels that could not be specifically shown.

In the synthetic head 300, the Delta-prime and Sigma-prime filters may be determined by measurement for each of the bearing angles to be simulated, although for simple applications, the spherical-model functions will suffice. Economies are effected in the measurements by measuring only difference and sums of mannikin ear signals and in magnitude only, as explained above. A refinement is achieved by the measurement of excess delay (or advance) relative to, say, the 0° measurement. This latter data is used to insert delays, not shown in FIG. 9, to avoid distortions regarding perceptions in distance for the head simulation.

Head simulation and head compensation used together provide another aspect of the invention, a loudspeaker reformatter. A specific embodiment of a loudspeaker reformatter 400 in accordance with the invention is illustrated in FIG. 10A. The loudspeaker reformatter processes input signals in two steps. The first step is head simulation to convert signals intended for a specific loudspeaker bearing angle, say ±30°, to binaural signals, which is performed by an inverse formatter 402 such as that shown in FIG. 8B. The processing in the second step is to format such signals for presentation at some other loudspeaker bearing angle, say ±15° by means for a binaural processing circuit 404 such as that shown in FIG. 1C. The two steps may, of course, be combined, as is illustrated in FIG. 10B.

Other examples of the filters used in the above processing include in the following. A source $L_s$ may be represented as being at 50° via loudspeakers at ±30°, and similarly a source $R_s$ may be represented as located at −50° (i.e., on the right). Then, according to the principles stated above, sum-and-difference combinations of the transfer functions S and A can be evaluated each at 50° and 30° to be used in preparing loudspeaker signals as follows: the left loudspeaker should present a signal $X_P=(L_s+R_s)$ [S(50°)+A(50°)]/[S(30°)+A(30°)] together with a second signal $X_n=(L_s-R_s)[S(50°)+A(50°)]/[S(30°)-A(30°)]$, the combined signal simply being the sum, $X_P+X_n$, while the right loudspeaker should present the signal that is the difference, $X_P-X_n$. These filters may be minimum phase. This novel use of such simple sums and differences, and the representation of these sums and differences as minimum-phase filters provides simplification previously unknown in the art.

The equalization principles we have described in our U.S. Pat. Nos. 4,893,324, 4,910,779 and 4,975,954 and in our publication, "Prospects for Transaural Recording," J. Audio Eng. Soc., vol. 37, pp. 3-19 (January/February 1989) which are hereby incorporated by reference are generally applicable to these reformatters. Simplification is achieved if the normalization makes use of the same reference direction for the numerator as for the denominator in the ratios of sums of transfer functions as well as for the ratios of differences. Thus, this style of reformatter normalization is advantageous.

One application of a reformatter exists in television stereo wherein it is very difficult to mount loudspeakers in the television cabinet so that they would be placed at bearing angles so large as ±30° for a viewer. Another application may be found in a listening room that is too narrow for ±30° placement because of a need to place a substantial distance between each loudspeaker and its corresponding sidewall, together with a desire to be seated not too close to the loudspeakers. In this way, it is possible to be forced to accept a small angle, perhaps ±15°, for loudspeaker placement, yet retain the imaging more nearly characteristic of ±30° by using a reformatter.

A narrow angular range for loudspeaker placement (narrow speaker base) also permits a wide range in listener position. The attainment of such a wide range is easily understood for mono-sum images, wherein the signals to the two loudspeakers are identically the same. Such an image always lies between the two loudspeakers. It lies to the left of center for a listener seated to the left, and it lies to the right of center for a listener seated to the right. The total range available to this image in response to varying listener positions, then, is reduced if the speaker base is narrowed. For other images, differences in loudspeaker-ear distances change less with varying listener positions for the more narrow speaker base. Any potential reduction in stereo-soundstage width because of the narrow speaker base is overcome through the use of a reformatter.

The restriction of the head diffraction compensation to the simulation of loudspeaker placement alone provides the advantage of enhancing compatibility with other stereo techniques. Applications include those in which a user would be offered, at the touch of a button, the option of spread imaging, vs "regular." In some cases, however, the change in imaging style could be accompanied by a noticeable change in tonal quality in the reproduced sound.

In our "Prospects for Transaural Recording" publication, we show in FIGS. 8, 9, and 10, frequency response plots showing possible small distortions in tonal quality caused by head diffraction for sounds arriving from a variety of directions. These plots portray power levels for sums of acoustic powers arriving from pairs of directions. Equalization taking such data into account, as described in the publication, are correct and will constitute almost all of the needed corrections. However, upon closer comparison, such as is possible with instantaneous electrical switching, it is possible that there will remain some noticeable change in tonal quality correlated with changes in directionality. It appears that human hearing determines loudness judgements, not alone from the sum of powers at the two ears, but also from some combination of amplitudes as well. We have found that managing to get the mono-sum total sound "right" often would constitute the "finishing touch" on equalization and naturalization. In these cases, the tonal quality of the mono sum for loudspeakers in the simulated positions can be compared with that for the loudspeakers in the actual physical position to determine the equalization to make a specific reformatter sound fully authentic.

Another aspect of the invention provides loudspeaker reformatting for nonsymmetrical loudspeaker placements such as might be found in an automobile wherein the occupants usually sit far to one side. A nonsymmetrical loudspeaker reformatter 500 in accordance with the invention is illustrated in FIG. 11. Compensation for the fact that the listener 512 is in unusual proximity to one loudspeaker 516 is accomplished by the insertion of delay 502, equalization 504 and level adjustment 506 for that loudspeaker. The delay and level adjustments are well known in the prior art. However, a loudspeaker reformatter 508 provides equalization adjustment from head diffraction data for the bearing angle of the virtual loudspeaker 510, shown in dashed symbol, relative to the uncompensated, other-side loudspeaker 514. While a very good impression of the recording is ordinarily possible for such off-side listeners improved results can be obtained with such reformatting. Switching facilities may be provided to make the reformatting available either to the driver, or to the passenger, or to provide symmetrical formatting.

Another nonsymmetrical arrangement 600, this one for the crosstalk canceler part of a reformatter, in which the loudspeakers 604, 606 may also be equidistant from the listener, and in which the asymmetry arises merely from head orientation, is illustrated in FIG. 12, wherein the head 602 is shown directed at one of the loudspeakers 604, and the head-related transfer functions are marked S,F, and A. The designations S and A are for paths from the off-center loudspeaker to the same-side ear and to the alternate-side ear, respectively, while the designation F is for the path from the loudspeaker centrally placed at the front of the listener to either ear. The designated transfer functions are to include the effects of any difference in path length. For example, if F is to be the shorter path, then a compensating delay is to be included in any term involving 1/F, in the manner shown in FIG. 11. Also, the signals at the loudspeakers 604, 606 are designated D and M for the off-center one and for the front-center one, respectively, L and R are designations for input signals, while $L_e$ and $R_e$ are symbols for the signals at the right and left ears, respectively.

Thus, at the left ear, the signal is $L_e=SD+FM$, while at the right ear, the signal is $R_e=AD+FM$. This pair of equations may be solved to obtain the specification of loudspeaker signals as $D=(L-R)/(S-A)$ for the off-center loudspeaker, and $M=[(RS-LA)/(S-A)]/F$ for the front-center loudspeaker. The subscript e has been dropped in these solutions to represent the condition wherein the input signals L and R are to be made exactly equal, respectively, to the ear signals $L_e$ and $R_e$.

A similar arrangement 610 is shown in FIG. 13, but with the off-center loudspeaker 612 being disposed to the right side of the array, and the specifications for the loudspeaker signals may be deduced in the same manner as in the above. They are just $D=(R-L)/(S-A)$ and $M=[(LS-RA)/(S-A)]F$. It is seen that the specifications in the two systems are the same except for the interchange of the symbols L and R.

The two systems 600, 610 of FIGS. 12 and 13 may be taken in superposition to form the three-loudspeaker symmetric arrangement 620 shown in FIG. 14. The left off-center loudspeaker 622 signal is to obey the specification $(L-R)/(S-A)$; the right off-center loudspeaker 624 is to obey $(R-L)/(S-A)$; while the front-center loudspeaker 626 is to obey $(L+R)/F$, the sum of the two specifications above for M. (It is easily seen that the sum of $RS-LA$ with $LS-RA$ reduces to an expression for the product of $L+R$ multiplied by $S-A$.)

The arrangement 620 of FIG. 14 may also be seen as a specification of a four-loudspeaker system 630 as shown in FIg. 15, which may be regarded as deriving from the system of FIG. 1C by allowing the signal summing at 166 and 170 therein alternatively to take place acoustically at the ears of the listener. Thus, the four loudspeakers 632, 634, 636, 638 are supplied with the signals $(L-R)/(S-A)$, $(L+R)/(S'+A')$, $(L+R)/(S'+A')$, and $(R-L)/(S-A)$ respectively as illustrated in FIG. 15. The merging of the two more centrally located loudspeakers 702, 704 into one, and the replacement of the transfer A' and S' by the merged-path function F, complete the derivation. It is to be understood that the term loudspeaker also includes earphones and the like.

In FIG. 15, the processing system is represented by the signal combinations shown for each loudspeaker. In FIG. 14, the processor shown is a reformatter. The input signals are source signals $L_s$ and $R_s$. In this instance, these may be taken to be conventional stereo signals intended for loudspeaker presentation at $\pm 30°$, as happens to have been assumed in taking the angles appearing in the formulas $L-R=(L_s-R_s)$ $[S(30°)-A(30°)]$and $L+R=(L_sR_s)$ $[S(30°)+A(30°)]$as being 30°. The evaluation angles are not specified, in the interests of generality, for the denominators of the filter expressions shown in FIG. 14. These are to be chosen to match the actual angular spacing of the outer loudspeakers, of course. Those shown happen to have been drawn for 15° spacing.

There is more than one solution to the problem of finding three loudspeaker signals to combine to produce specified sums at the two ears. While there are two equations for the combining of loudspeaker signals at the ears, there are three variables, the loudspeaker signals. Such a system of equations is known as underdetermined (fewer equations than unknowns), and notorious for nonuniqueness in solution.

For example, FIG. 14 provides a solution for the three loudspeakers 622, 624, 626 while FIG. 17 provides alternative solutions for the three loudspeakers 662, 664, 666, where a proportioning parameter, x, may take any value. We see that adding a proportion x of $(L+R)/(S+A)$ to the signals of each of the side loudspeakers 662, 666 produces the same effect at the ears as before, provided that the same proportion x of $(L+R)/F$ is subtracted from the signal at the center loudspeaker 664. Thus $x=0$ provides the three-loudspeaker case of FIG. 14, while $x=1$ provides the previous two-loudspeaker case, and many other cases may be constructed.

A means of selecting a specific solution is the Moore-Penrose pseudoinverse. Starting from the ear-signal equations $$L=SD_L+FM+AD_R$$

$$R=AD_L+FM+SD_R$$

the shuffler versions may be written in matrix form, $$\begin{bmatrix}\Sigma\\ \Delta\end{bmatrix}=\begin{bmatrix}P & 0 & F\\ 0 & N & 0\end{bmatrix}\begin{bmatrix}D_\Sigma\\ D_\Delta\\ 2M\end{bmatrix}$$

wherein $P=S+A$, $N=S-A$, $\Sigma=L+R$, $\Delta=L-R$, $D_\Sigma=D_L+D_R$, and $D_\Delta=D-_LD_R$. Then the matrix product wherein the $3\times 2$ matrix multiples its own $2\times 3$ transpose, $$\begin{bmatrix}P & 0 & F\\ 0 & N & 0\end{bmatrix}\begin{bmatrix}P & 0\\ 0 & N\\ F & 0\end{bmatrix}=\begin{bmatrix}P^2+F^2 & 0\\ 0 & N^2\end{bmatrix}$$

is formed as shown, and its inverse is calculated. This inverse is $2\times 2$ and looks like the $2\times 2$ matrix above except that $P^2+F^2$ is replaced by its reciprocal and $N^2$ is replaced by its reciprocal. The pseudoinverse, then, may be defined to be the matrix product $$\begin{bmatrix}P & 0\\ 0 & N\\ F & 0\end{bmatrix}\begin{bmatrix}1/(P^2+F^2) & 0\\ 0 & 1/N^2\end{bmatrix}=\begin{bmatrix}x/P & 0\\ 0 & 1/N\\ (1-x)/F & 0\end{bmatrix}$$

where $x=P^2/(P^2+F^2)$, so that $1-x=F^2/(P^2+F^2)$. Conversion from shuffler form back to individual loudspeaker signals produces the same loudspeaker signal formulas (except standing for $2D_L$, $2M$, $2D_R$, a factor-2 adjustment that we omit) as shown in FIG. 17, with x specified above, as a kind of frequency-dependent gain.

Study of the pseudoinverse solutions shows that $|P|$ and $|F|$ may substitute for P and F, respectively, in the expressions for x and $1-x$, in which case it might be better to write these as $|X|^2=|P|^2/(|P|^2+|F|^2)$ and $1-|X|^2=|F|^2/(|P|^2=|F|^2)$, falling in the range from 0 to 1. For realization as a system function, it would be preferable to accept minimum-phase versions having these same magnitude functions. Then, the notations $X^2$ and $1-X^2$ would be more suitable. It appears to be a characteristic of these solutions that they avoid ill conditioning, making $1-x$ be small when F is small and making x be small when P is small.

However graceful the behavior that may be shown by the pseudoinverse in its dependence upon frequency, there exist applications in which any appearance of an $L+R$ signal in the side loudspeakers would appear to be unacceptable. One such application is cinema sound, in which the $L+R$, or mono component is used almost exclusively for dialog, for which it has been found to be important to provide a fixed sound origin—behind the center of the acoustically transparent projection screen. Persons seated in varying places in front of the screen would find the origin of dialog to vary if more than one loudspeaker carried this component. For such applications, one embodiment would provide for setting x=0 to establish L+R at the center speaker as illustrated in FIG. 14. Nevertheless, the pseudoinverse variations teach a means of signal distribution with uniquely pleasing characteristics.

Another arrangement, this time for two listeners 682, 684, but using three loudspeakers 686, 688, 690 is shown in FIG. 18. The first listener 682 is shown in solid-line symbol, with the second listener 684 shown in dotted line. The analysis is done for only one head present in the acoustic field, relying upon the approximation in which the presence of one head hardly affects what is heard by another. The design is for the second head 684 to hear reverse stereo, namely L'=R and R'=L. Thus, the two outer loudspeakers 686, 690 (D) carry the same signal. While it may be that the farther D loudspeaker will have only a minor influence because of the precedence effect, the analysis takes that influence into account. The analysis omits reflected paths, assuming anechoic space, although one application might be stereo reproduction in an automobile, where such reflections may be important.

The matrix equations are $$\begin{bmatrix} L \\ R \end{bmatrix} = \begin{bmatrix} S + A' & A \\ A + S' & S \end{bmatrix} \begin{bmatrix} D \\ C \end{bmatrix}$$

and the determinant of the 2×2 matrix is $$\begin{aligned} |det| &= S^2 - A^2 + SA' - AS' \\ &= (S - A)(S + A)[1 + (SA' - AS')/(S^2 - A^2)], \end{aligned}$$

showing extraction of the (S−A)(S+A) factors, or $$|det| = (S-A)(S+A)(1+E),$$

where $$E = (SA' - A')/(S^2 - A^2),$$

contains the longer-path terms. Solution for D and C yields $$D = (SL - AR)/|det|$$

and $$C = [(S+A')R - (A+S')L]/|det|.$$

These expressions are developed further, below, to cast them in forms exhibiting numerator terms involving L+R and L−R.

In D, the numerator may be written as $\frac{1}{2}S(L+)-\frac{1}{2}A(+R)+\frac{1}{2}S(L-)+\frac{1}{2}A(-R)$, where the blank spaces are to receive insertions from adding and subtracting $\frac{1}{2}(SR+AL)$, thus obtaining $$D = \tfrac{1}{2}(L+R)/D_1 + \tfrac{1}{2}(L-R)/D_2,$$

after canceling common factors S+A or S−A between numerator and denominator, while in C, the numerator may be written as $\frac{1}{2}(S+A')(+R)\frac{1}{2}(A+S')(L+)-\frac{1}{2}(S+A')(-R)-\frac{1}{2}(A+S')(L-)$, where the blank spaces are for insertions by adding and subtracting $\frac{1}{2}[(A+S')R+(S+A')L]$, thus obtaining $$C = \tfrac{1}{2}(L+R)Q_1/D_1 - \tfrac{1}{2}(L-R)Q_2/D_2,$$

also after canceling factors in common between numerator and denominator, in which $$D_1 = (S+A)(1+E),\ D_2 = (S-A)(1+E),$$

and $$Q_1 = 1-(S'-A')/(S-A),\ Q_2 = 1+(S'+A')/(S+A),$$

show compensation for the influence of the longer paths, S' and A'. Also, G may be defined to be $(SS'-AA')/(S^2-A^2)$ to write the numerator factors of C as $$Q_1 = 1-G+E,\ Q_2 = 1+G+E,$$

completing the expression of the longer-path terms as implicit dependence via the symbols G and E.

Because of the longer path, the precedence effect in human hearing would tend to make the omission of such terms of less consequence than might be ordinarily supposed. The above form of expression, by way of emphasis, points to terms that, making relatively minor contributions, might prove nearly negligible.

Four-loudspeaker (and larger number) extensions of these three-loudspeaker cases are apparent. For example, the two-listener application may be satisfied without stereo-field reversal by using four loudspeakers. Also, the pseudoinverse treatment may be extended to four loudspeakers.

Another loudspeaker arrangement 650 is shown in FIG. 16A, with the processing system being represented by the signal combinations shown therein as loudspeaker signals. At the top, a single-diaphragm-loudspeaker symbol in open baffle represents a dipole radiator 652, while a similar symbol in closed baffle represents a monopole radiator 654. The front-side and back-side radiations from a dipole are of opposite polarity, as indicated. Also as indicated, the paths A and S taken by the front-side radiation, while the back-side paths would be the equivalent paths A' and S' (of which S' alone is shown in dashed line).

The deliberate use of backside radiation to make a contribution to a stereo effect is a rarity in the literature, but may be attributed to Holger Lauridsen, who is also known for naming a dipole-monopole (or bidirectional-unidirectional) stereo microphone array by the term M-S, for middle-side, mitte-seite, or mono-stereo. Lauridsen's work is described in Fr. Heegaard, "The Reproduction of Sound in Auditory Perspective and a Compatible System of Stereophony," E.B.U. Review, Part A—Technical, No. 52 pp. 2–6 December 1958). Lauridsen's loudspeaker arrangement is shown in Heegaard's FIG. 3 and his microphone arrangement in FIG. 4. However, Lauridsen does not teach that the signals for the loudspeakers be prepared taking diffraction-path transfer functions into account. Lauridsen does not teach the use of diffraction-path transfer functions in preparing four loudspeaker signals. Further, there is no evidence in Heegaard of a three-loudspeaker arrangement.

Another embodiment of the invention is shown in FIG. 16B in which a novel M-S loudspeaker arrangement includes a monopole radiator 655 and dipole radiators 657, 659 with the processing system being represented by the signal combinations shown therein as loudspeaker signals. The arrangement can be made advantageous for a large number of listeners by placing the monopole loudspeaker 655 at a substantial distance in front of the listeners, and placing a dipole arrangement 657 or 659 close to (in front, at sides, behind each listener where it need radiate rather little power so as to not disturb neighboring listeners (already protected by the precedence effect). The diffraction compensation includes, for the long path F or F' in comparison to the shorter paths from the dipole arrangements, insertion of delay in the electrical signals supplied to the dipoles.

In considering these shorter paths, it will be understood that the showing of them in the drawings is highly schematic, the actual signal propagation being, of course, a wave-diffraction phenomenon in which a definite path may not be meaningfully designated (except in the sense of a phasor-weighted sum over all possible paths). However, the diffraction propagation is measurable and the processing coefficients fully determinable in the art, so that the schematic showing represents full determination for one of ordinary skill in the art.

A variety of dipole arrangements are to be understood as falling within the teachings of the invention, not merely the use of two closely-spaced opposite-polarity loudspeakers, or a single-diaphragm loudspeaker. These include, but are not limited to various mechanical supporting structures with projecting mounting pods, concealment in head rests and the like, and opposite-polarity earphones, worn on the head, of the open-air variety freely permitting audition of outside sounds. It will be understood that the transducers in the dipole loudspeakers may be quite small, since good performance at frequencies below some 200 Hz will often not be required, there being rather little usable stereo-difference signals available, in many cases, at such frequencies. Applications in cinema theaters and automobiles are particularly advantageous. In some instances, such arrangements offer sufficient flexibility in loudspeaker placement to permit avoidance of certain undesirable effects from such phenomenon as early reflections.

It should also be clearly understood that the three loudspeaker arrangement 620 shown in FIG. 14 is novel in its signal pattern: firstly, in that the signals are filtered in accordance with diffraction-path transfer functions, and secondly, in that the outer pair of loudspeakers carry filtered antiphase stereo-difference signals while the center carries a differently-filtered mono-sum signal. Even if the filtering functions be set aside, the prior art does not teach such three-loudspeaker arrangements. In the prior art, the outer loudspeakers carry L and R, not their differences.

A specific embodiment of the stereo audio processing system according to the invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. An audio processing system comprising:

means for providing two input signals;

compensation means for introducing cross-talk cancellation in the two input signals including difference filter means for filtering a difference of the two input signals to obtain a first filtered signal and sum filter means for filtering a sum of the two input signals to obtain a second filtered signal; and summing and differencing means for generating a sum output signal and a difference output signal respectively from the filtered signals, and for generating at least one additional different output signal from the filtered signals.

2. The audio processing system of claim 1 wherein the means for providing two input signals comprises means for reformatting stereo audio signals into binaural signals.

3. The audio processing system of claim 1 wherein the sum filter means and the difference filter means comprise minimum phase filters.

4. The audio processing system of claim 1 wherein the compensation means includes means for naturalization compensation of the two input signals and filtering means for substantially modifying the frequency and phase response of the cross-talk cancellation and naturalization compensation at frequencies substantially above 600 hertz and below 10 kilohertz.

5. The audio processing system of claim 2 wherein the means for reformatting the stereo audio signals comprises sum and difference means for generating a sum signal and a difference signal from the stereo audio signals, filter means for filtering the sum and difference signals to provide head diffraction compensation to generate a compensated sum signal and a compensated difference signal respectively, and sum and difference means for generating a sum binaural signal and a difference binaural signal respectively from the compensated sum signal and the compensated difference signal to thereby provide the binaural signals.

6. The audio processing system of claim 2 wherein the stereo signals are conventional stereo signals having a predetermined loud-speaker bearing angle and wherein the difference filter means and sum filter means are configured to reformat the binaural signals into output signals which simulate a selected different loud speaker bearing angle.

7. The audio processing system of claim 6 wherein the means for providing cross-talk cancellation comprises naturalization means for providing naturalization compensation of the audio signals to correct for propagation path distortion comprising two substantially identical minimum phase filters to compensate each of the binaural signals.

8. The audio processing system of claim 1 wherein the difference filter means and the sum filter means are made to have a predetermined deviation from reciprocals of corresponding difference and sum head related transfer functions, said deviation being introduced to avoid representing transfer function characteristics peculiar to specific heads in order to provide compensation suitable for a variety of listener's heads.

9. The audio processing system of claim 8 wherein the deviation in crosstalk cancellation is imposed gradually, the deviation being slight at a predetermined starting frequency and the deviation becoming more substantial at higher frequencies.

10. The audio processing system of claim 2 wherein the means for providing crosstalk cancellation further comprises means for a non-symmetrical compensation of the output signals.

11. The audio processing system of claim 10 wherein the means for non-symmetrical compensation comprises equalization means for providing nonsymmetrical equalization adjustment of one of the output signals relative to a second uncompensated one of the output signals using head-diffraction data for a selected bearing angle to provide a virtual loud speaker position.

12. The audio processing system of claim 10 wherein the means for non-symmetrical compensation further comprises means for non-symmetrical delay and a level adjustment of the output signals.

13. An audio processing method comprising the steps of:

providing two input signals;

introducing crosstalk cancellation in the two input signals including difference filtering a difference of the two input signals to obtain a first filtered signal and sum filtering of a sum of the two input signals to obtain a second filter signal;

generating a sum output signal and a difference output signal respectively from the filtered signals and at least one additional output signal from the filtered signals.

14. The audio processing method of claim 13 wherein the step of providing two input signals comprises reformatting stereo audio signals to binaural signals.

15. The audio processing method of claim 14 wherein the step of reformatting the binaural signals comprises the step of non-symmetrical compensation of the stereo signals.

16. The audio processing method of claim 15 wherein the step of non-symmetrical compensation comprises the steps of providing non-symmetrical equalization adjustment of one of the output signals relative to a second one of the output signals using head diffraction data for a selected bearing angle.

17. The audio processing method of claim 13 wherein the step of providing crosstalk cancellation comprises the step of crosstalk cancellation and naturalization compensation of the two input signals with a substantially modified frequency and phase response of the crosstalk cancellation and naturalization compensation for frequencies substantially above 600 hertz and below 10 kilohertz.

18. An audio processing system comprising:

means for providing two input signals;

compensation means for introducing crosstalk cancellation in the two input signals including difference filter means for filtering a difference of the two input signals to obtain a first filtered signal, sum filter means for filtering a sum of the two input signals to obtain a second filtered signal, and means for separately and differently filtering each of the two input signals before combining and filtering to obtain a third filtered signal; and means for producing output signals directly from at least two of the filtered signals.

19. An audio processing system comprising:

means for providing two input signals;

compensation means for introducing crosstalk cancellation in the two input signals for use with a symmetric loudspeaker array including difference filter means for filtering a difference of the two input signals to obtain a first filtered signal and sum filter means for filtering a sum of the two input signals to obtain a second filtered signals;

means for producing two side loudspeaker outputs from only one of the filtered signals; and means for producing a center loudspeaker output.

20. The audio processing system of claim 19 wherein the loudspeaker array is a three loudspeaker array, the means for producing two loudspeaker outputs produces two side loudspeaker outputs from the first filtered signal one of which is a polarity reversed version of the other side loudspeaker output signal, and the center loudspeaker output is produced from the second filtered signal.

21. The audio processing system of claim 20 wherein the loudspeaker array is a four loudspeaker array, the means for producing two loudspeaker outputs produces two side loudspeaker output signals from the first filtered signal one of which is a polarity reversed version of the other side loudspeaker output signal, and wherein the means for producing a center loudspeaker output further comprises means for producing first and second center loudspeaker output signals from the second filtered signal each of which is substantially similar to the other.

22. The audio processing system of claim 20 further comprising:

means for selecting a level of contribution of the second filtered signal to the center loudspeaker output signal;

means for altering the filtering of the second filtered signal to form a third filtered signal; and means for selecting a level of contribution of the third filtered signal in the side loudspeaker output signals in a manner complementary to a corresponding contribution in the center loudspeaker output signal which contribution of the third filtered signal comprises together with the first filtered signal the two side output loudspeaker signals.

23. The audio processing system of claim 22 wherein selecting a level of contribution is frequency dependent in relation to responses of transmission paths of loudspeaker outputs so as to avoid extremes of compensation.

24. An audio processing method comprising the steps of:

providing two inputs;

introducing crosstalk cancellation in the two input signals including filtering a difference of the two input signals to obtain a first filtered signal and filtering a sum of the two input signals to obtain a second filtered signal;

producing first and second loudspeaker outputs from one of the filtered signals;

generating a third loudspeaker output from the other filtered signal.

25. The audio processing method of claim 24 wherein the first and second loudspeaker outputs are first and second side loudspeaker outputs produced from the first filtered signal wherein the first loudspeaker output is a polarity reversed version of the second, and wherein the third loudspeaker output is a center loudspeaker output produced from the second filtered signal.

26. The audio processing method of claim 24 wherein the first and second loudspeaker outputs are first and second side loudspeaker outputs produced from the first filtered signal wherein the first loudspeaker output is a polarity reversed version of the second, and wherein the step of generating comprises generating third and fourth loudspeaker outputs as center loudspeaker outputs from the second filtered signal, each of which is substantially similar to the other.

27. The audio processing method of claim 25 further comprising the steps of:

selecting a level of contribution of the second filtered signal to the center loudspeaker output;

altering the filtering of the second filtered signal to form a third filtered signal; and selecting a level of contribution of the third filtered signal in the side loudspeaker outputs to be complementary to a corresponding contribution in the center loudspeaker output such that the third filtered signal together with the first filtered signal comprise the two side loudspeaker outputs.

28. The audio processing method of claim 27 wherein the steps of selecting a level of contribution are frequency dependent in relation to responses of the transmission paths of the loudspeaker outputs so as to avoid extreme of compensation.

29. An audio processing system comprising:

means for providing two input signals;

compensation means for introducing crosstalk cancellation in the two input signals for use with a dipole loudspeaker arrayed sym,etrically with a monopole loudspeaker including difference filter means for filtering a difference of the two input signals to obtain a first filtered signal and sum filter means for filtering a sum of the two input signals to obtain a second filtered signal;

means for producing a dipole loudspeaker output signal from the first filtered signal and for producing a monopole loudspeaker output signal from the second filtered signal.

30. The audio processing system of claim 29 wherein the dipole loudspeaker is arrayed symmetrically and in close proximity to the monopole loudspeaker.

31. The audio processing system of claim 29 wherein the dipole loudspeaker is arrayed symmetrically and in close proximity to a listening position.

32. The audio processing system of claim 29 wherein the dipole loudspeaker comprises a pair of oppositely poled loudspeakers disposed at the two sides of a listening position.

33. The audio processing system of claim 29 wherein the two input signals are binaural signals.

34. An audio processing system comprising;

means for providing two input signals;

compensation means for introducing crosstalk cancellation in the two input signals for use with a symmetric loudspeaker array having outer loudspeakers and an inner loudspeaker including difference filter means for filtering a difference of the two input signals to obtain a first filtered signal and sum filter means for filtering a sum of the two input signals to obtain a second filtered signal;

summing and differencing means for generating a sum output signal and a difference output signal from said first and second filtered signals wherein the sum output signal is supplied to the inner loudspeakers of the array, and wherein the difference output signal is supplied to the outer loudspeaker of the array.

35. An audio processing method comprising the steps of:

providing two input signals;

introducing crosstalk cancellation in the two input signals for use with a dipole loudspeaker arrayed symmetrically with a monopole loudspeaker including filtering a difference of the two input signals to obtain a first filtered signal and filtering a sum of the two input signals to obtain a second filtered signal;

producing a dipole loudspeaker output from the first filtered signal and producing a monopole loudspeaker output from the second filtered signal.

36. The audio processing method of claim 35 further comprising the step of coupling the dipole loudspeaker output to the dipole loudspeaker and the monopole loudspeaker output to the monopole loudspeaker, and wherein the dipole loudspeaker is arrayed symmetrically and in close proximity to the monopole loudspeaker.

37. The audio processing method of claim 35 wherein the dipole loudspeaker output is coupled to the dipole loudspeaker which is arrayed symmetrically and in close proximity to the listening position.

38. The audio processing method of claim 35 wherein the dipole loudspeaker output is coupled to a pair of a oppositely poled loudspeakers disposed at the two sides of a listening position.

39. An audio processing method for use with a symmetric loudspeaker array having outer loudspeakers and an inner loudspeaker comprising the steps of:

providing two input signals;

introducing crosstalk cancellation in the two input signals including filtering a difference of the two input signals to obtain a first filtered signal and filtering a sum of the two input signals to obtain a second filtered signal;

generating a sum output and a difference output from the first filtered signal and the second filtered signal;

supplying the sum output to the outer loudspeakers of the array and supplying the difference output signal to the inner loudspeaker of the array.

40. An audio processing system comprising;

means for providing two input signals;

compensation means for introducing crosstalk cancellation in the two input signals including means for producing a difference signal and a sum signal from the two input signals;

means for filtering to form a first filtered signal derived from the difference signal and means for filtering the sum signal to form a second filtered signal; and output means for forming a sum output signal and a difference output signal from the first and second filtered signals.

41. The audio processing system of claim 40 wherein the compensation means further comprises means for integrating the difference signal to form an integrated difference signal effective for frequencies below a corner frequency of approximately 600 Hz and wherein the means for filtering filters the integrated difference signal to form the first filtered signal.

42. The audio processing system of claim 40 wherein the means for providing two input signals comprises means for providing signals having approximate binaural characteristics above a corner frequency of approximately 600 Hz and requiring minimal integration at frequencies below said corner frequency.

43. The audio processing system of claim 40 wherein the means for providing two input signals comprises means for providing binaural signals that have been preprocessed by integrating a difference of the binaural signal at frequencies below a corner frequency of approximately 600 Hz.

44. The audio processing system of claim 40 further comprising means for postprocessing the output signals including means to integrate a difference of the output signals for frequencies below a corner frequency of approximately 600 Hz and means for providing said postprocessed signals as substitute output signals.

45. The audio processing method comprising the steps of:

providing two input signals;

introducing crosstalk cancellation in the two input signals including producing a difference signal and a sum signal from the two input signals;

filtering to form a first filtered signal derived from the difference signal and filtering the sum signal to form a second filtered signal;

forming an output sum signal and output difference signal from the first and second filtered signals.

46. The method of claim 45 further comprising the step of integrating the difference signal effective for frequencies below a corner frequency of approximately 600 Hz to form an integrated signal wherein the integrated signal is filtered to form the first filtered signal.

47. The method of claim 45 wherein the step of providing two input signals comprises providing signals having approximate binaural characteristics above a corner frequency of approximately 600 Hz and requiring minimal integration at frequencies below said corner frequency.

48. The method of claim 45 wherein the step of providing two input signals comprises providing binaural signals that have been preprocessed by integrating a difference of the binaural signal at frequencies below a corner frequency of approximately 600 Hz.

49. The method of claim 48 further comprising the steps of postprocessing the output sum signals and output difference signal including integrating a difference of the output sum signal and the output difference signal for frequencies below a corner frequency of approximately 600 Hz to form output signals.

50. An audio processing system comprising:

means for providing two input signals;

compensation means for introducing crosstalk cancellation in the two input signals for use with a symmetric loudspeaker array having a first set of loudspeakers displaced from at least one additional loudspeaker including difference filter means for filtering a difference of the two input signals to obtain a first filtered signal and sum filter means for filtering a sum of the two input signals to obtain a second filtered signal;

summing and differencing means for generating a sum output signal and a difference output signal from said first and second filtered signals wherein the sum output signal is supplied to the first set of loudspeakers of the array, and wherein the difference output signal is supplied to at least one additional loudspeaker of the array.

* * * * *

UNITED STATES PATENT AND TRADEMARK OFFICE

CERTIFICATE OF CORRECTION

PATENT NO. : 5,333,200

DATED : July 26, 1994

INVENTOR(S) : Duane H. Cooper and Jerald L. Bauck

It is certified that error appears in the above-indentified patent and that said Letters Patent is hereby corrected as shown below:

Column 3, line 35, delete "±0°" and insert -- ±30° --

Column 9, line 22, delete "--$A^2$" and insert -- -AS/($S^2$-$A^2$) --

Column 9, line 60, between "1" and "S" insert -- / --

Column 14, line 56, delete "exhause" and insert --exhaust--

Column 23, line 63, delete "½(S+A')(+R) ½(A+S')(L+) and insert --½(S+A')(+R)-½(A+S')(L+)--

Column 23, line 63, delete "-" at the end of the line

Column 15, line 68, after "schematic" (end of line) insert --.--

Claim 29, Column 29, line 22, delete "sym,etrically" and insert --symmetrically--

Signed and Sealed this

Thirteenth Day of February, 1996

Bruce Lehman

*Attest:*

BRUCE LEHMAN

*Attesting Officer*

*Commissioner of Patents and Trademarks*